US005746463A

United States Patent [19]

Nagata

[11] Patent Number: 5,746,463

[45] Date of Patent: May 5, 1998

[54] BOX PALLET

[76] Inventor: Akitoshi Nagata, 19-13, Shibazaki, Koi-cho, Anjo-shi, Aichi-ken, Japan

[21] Appl. No.: 525,760

[22] PCT Filed: Jan. 17, 1995

[86] PCT No.: PCT/JP95/00037

§ 371 Date: Sep. 18, 1995

§ 102(e) Date: Sep. 18, 1995

[87] PCT Pub. No.: WO96/00690

PCT Pub. Date: Jan. 11, 1996

[30] Foreign Application Priority Data

| | | | |
|---|---|---|---|
| Jan. 20, 1994 | [JP] | Japan | 6-004666 |
| Mar. 23, 1994 | [JP] | Japan | 6-052227 |
| Jul. 6, 1994 | [JP] | Japan | 6-154914 |
| Jul. 6, 1994 | [JP] | Japan | 6-154915 |

[51] Int. Cl.[6] ..... B65D 51/00

[52] U.S. Cl. ..... 294/68.24

[58] Field of Search ..... 294/68.1, 68.2–68.22, 294/68.24; 220/244, 245, 334, 908; 222/545, 556; 414/403, 404, 408, 411, 414

[56] References Cited

U.S. PATENT DOCUMENTS

| | | | |
|---|---|---|---|
| 885,613 | 4/1908 | Hamilton | 294/68.24 |
| 894,128 | 7/1908 | Focht | 294/68.24 |
| 926,886 | 7/1909 | Lockwood | 294/68.24 |
| 1,005,618 | 10/1911 | Doud | 294/68.24 |
| 3,797,878 | 3/1974 | Fagre et al. | 294/68.24 X |

FOREIGN PATENT DOCUMENTS

| | | | |
|---|---|---|---|
| 51-115766 | 9/1976 | Japan . | |
| 54-137282 | 9/1979 | Japan . | |
| 4-135503 | 12/1992 | Japan . | |
| 1294715 | 3/1987 | U.S.S.R. | 294/68.24 |

*Primary Examiner*—Johnny D. Cherry

*Attorney, Agent, or Firm*—Palmatier, Sjoquist, Helget & Voigt, P.A.

[57] ABSTRACT

A box pallet having an open top, side plates and a bottom plate for surrounding the box pallet on four sides and a bottom, the bottom plate being divided into two bottom plate parts and being assembled to move in a downward direction for opening and closing, the box pallet including an actuation arm vertically pivotally supported by two opposite side plates, an interlocking member provided for interlocking between the actuation arm and the two divided bottom plate parts so as to permit opening and closing movement of the bottom plate parts, an actuation rod horizontally supported such that the actuation rod can change its position between a position on a pivotal locus of the actuation arm and a position out of the pivotal locus of the actuation arm and is engageable with and disengageable from the actuation rod, the bottom plate parts being held to be closed when the actuation rod is in engagement with the actuation arm, and the bottom plate parts being permitted to be opened when the actuation rod is in disengagement from the actuation arm.

13 Claims, 14 Drawing Sheets

BOX PALLET

TECHNICAL FIELD

The present invention relates to a box pallet which is capable of accommodating various articles such as industrial wastes therein and which permits the articles to be taken out therefrom.

BACKGROUND OF THE INVENTION

Conventionally, this type of box pallet is formed in a box-shaped configuration having an open top and is adapted to accommodate suitable articles such as industrial wastes therein. Practically, when the articles such as the industrial wastes are taken out from the interior of the box pallet, since the box pallet containing the articles such as the industrial wastes is a considerably heavy object, the box pallet itself is hung up by a lifting device such as a fork lift truck and is conveyed to a predetermined place. Thereafter, the box pallet itself is in turn hung up by another means such as wires, so that the box pallet is tilted for taking out the articles from the open upper portion.

Further, a different type of box pallet has been proposed to provide a construction in which a part of a side plate or a bottom plate of the box pallet is opened and closed, so that articles such as industrial wastes can be relatively easily taken out.

However, with the above conventional construction, during the operation for taking up the accommodated articles such as the industrial wastes, the box pallet itself is in turn hung up by separate means such as wires so as to be tilted. Therefore, the operation requires at least two operators, one for actually making the change to hang up the box pallet by wires, and another for operation of hanging up the box pallet by lifting device such as a fork lift truck. If a cooperating operation of the operators is hindered, the operation for making the hanging-up change of the box pallet becomes very dangerous, and in some cases, the operators may be seriously injured by corners of the box pallet or the wires.

Additionally, with the type in which the slide plate is opened and closed, after the side plate has been opened, the operator must perform a very troublesome operation for taking out the articles such as the industrial wastes accommodated within the box pallet. In order to take out the articles at a time, the box pallet itself must be hung up as described above, so that the operator cannot get out of possible danger during the operation.

Further, with the type in which the bottom plate is opened and closed, although this measure may solve the above problems, the opening and closing construction may be large-scaled, so that this type is not suited for practical use.

DISCLOSURE OF THE INVENTION

In view of the problems encountered in the prior art, the present invention proposes a box pallet which permits articles such as industrial wastes accommodated within the box pallet to be safely and easily taken out, with a simple construction.

(1) According to a first invention, there is provided a box pallet having an open top, a side plate and a bottom plate for surrounding the box pallet on four sides and a bottom, the bottom plate being divided into two bottom plate parts and being assembled to move in a downward direction for opening and closing, the box pallet comprising an actuation arm vertically pivotally supported by the side plate, an interlocking member provided for interlocking between the actuation arm and the two divided bottom plate parts so as to permit opening and closing movement of each bottom plate part, and an actuation rod horizontally supported such that the actuation rod can change its position between a position on a pivotal locus of the actuation arm and a position out of the pivotal locus and is engageable with and disengageable from the actuation rod, the bottom plate parts being held to be closed when the actuation rod is in engagement with the actuation arm, and the bottom plate parts being permitted to be opened when the actuation rod is in disengagement from the actuation arm.

With this box pallet, on the condition that the box pallet is hung up by lifting device such as a fork lift truck, by moving the actuation rod to a position out of the pivotal locus of the actuation arm for releasing engagement of the actuation rod with the actuation arm, each bottom plate part is permitted to be opened by the actuation arm and the interlocking member interlocked thereto, so that the bottom plate parts are positively opened. Therefore, the articles accommodated within the box pallet can be easily taken out therefrom to a different place.

(2) The interlocking member of the first invention may preferably be constructed by actuation link means which has one end pivotally connected to each of the two divided bottom plate parts and which has the other end pivotally connected to the actuation arm on the same axis as the actuation arm.

With this box pallet, the operation for opening and closing the bottom plate parts can be positively reliably performed since the bottom plate parts and the actuation arm are mechanically interlocked. Further, the engaging operation between the actuation rod and the actuation arm for holding the closed position of the bottom plate parts can be reliably performed.

(3) Preferably with the first invention, first operation means is provided on the actuation rod for changing the position of the actuation rod by human power, and second operation means is provided for changing the position of the actuation rod by different motive power from that for the first operation means.

With this box pallet, since the actuation rod can change its position by two different operation means, these operation means may be selectively operated in response to a working condition. Further, by automating one of the operation means, the operation of changing the position of the actuation rod can be automatically performed, so that the safety in this kind of operation can be substantially improved.

(4) With the first invention, preferably, the actuation arm is engageable with the actuation rod when it is in an upwardly tilted position.

With this box pallet, when the bottom plate parts are in their closed position, a force such as a weight of the wastes accommodated within the box pallet, which is applied to engaging portions between the actuation arm and the actuation rod is prevented from being directly applied to the engaging portions, so that the operation for engagement and disengagement between the actuation arm and the actuation rod can be smoothly performed.

(5) With the first invention, preferably, leg portions having a desired height are disposed on a lower side of the box pallet at substantially four corners thereof. A guide wheel is rotatably supported by means of a bracket on one of the bottom plate parts to be opened and closed. A second guide wheel is positioned inwardly of the former guide wheel in facing relationship therewith and is rotatably supported by means of a second bracket on the other of the bottom plate parts. Both guide wheels are positioned within the height of the leg portions.

With this box pallet, when the two divided bottom plate parts are opened and closed, the bottom plate parts are moved to be opened and closed with the bottom plate parts being restrained and guided by their respective guide wheels mounted on the two divided bottom plate parts, so that the operation for opening and closing the two divided bottom plate parts can be smoothly performed.

(6) Preferably, the brackets on which the guide wheels are mounted are positioned at the same level as the leg portions when the bottom plate parts are closed.

With this box pallet, the brackets may function as legs, so that the bottom plate parts can be held in the closed position.

(7) According to a second invention, there is provided a box pallet having an open top, a side plate and a bottom plate for surrounding the box pallet on four sides and a bottom, the bottom plate being divided into two bottom plate parts and being assembled to move for opening and closing, the box pallet comprising an actuation arm vertically pivotally supported by the side plate, an interlocking member provided for interlocking between the actuation arm and the two divided bottom plate parts so as to permit opening and closing movement of the bottom plate parts, an actuation rod horizontally supported such that the actuation rod can change its position between a position on a pivotal locus of the actuation arm and a position out of the pivotal locus and is engageable with and disengageable from the actuation rod, the bottom plate parts being held to be closed when the actuation rod is in engagement with the actuation arm, and the bottom plate parts being permitted to be opened when the actuation rod is in disengagement from the actuation arm, an operation member pivotally mounted on the side plate and interlocked with the actuation rod for controlling the change in position of the actuation rod, a pivotal lever pivotally supported by the side plate and pivotally moved by means different from that for the operation member, and interlocking means for transmitting the pivotal movement of the pivotal lever to the operation member as the pivotal movement of the operation member, the interlocking means being interlocked with the operation member such that the pivotal angle of the pivotal lever is adjustable relative to the operation member.

With this box pallet, to open and close the two divided bottom plate parts, the bottom plate parts are opened and closed by the pivotal operation of the operation member, while the pivotal operation of the operation member can be performed by the pivotal lever which is pivotally moved by the different means. Additionally, since the pivotal angle of the pivotal lever is adjustable relative to the operation member by means of the interlocking means, the operation member can be selectively operated in response to the working condition. Further, by automating the pivotal operation of the pivotal lever, the opening and closing movement of the bottom plate parts can be automatically performed, so that the safety in this kind of operation can be substantially improved.

(8) With the second invention, preferably, a connecting rod is mounted on the operation member so as to extend therefrom. The interlocking means is formed with a plurality of engaging recesses for engagement with and disengagement from the connecting rod. The engaging recesses are set to at least positions for preventing the pivotal lever from pivotal movement and for permitting the pivotal movement of the pivotal lever, when the connecting rod is in engagement with the corresponding engaging recess.

With this box pallet, the pivotal condition of the pivotal lever can be controlled by means of the setting of the engaging recesses of the interlocking means to at least positions for preventing the pivotal lever from pivotal movement and for permitting the pivotal movement of the pivotal lever, so that automatic control means for operating the operation member at a remote position can be set to various conditions by the pivotal lever which is adjusted in its pivotal angle and that the safety in this kind of operation can be further improved.

(9) With the second invention, preferably, the actuation arm is engageable with the actuation rod when it is in an upwardly tilted position.

With this box pallet, when the bottom plate parts are in their closed position, a force such as a weight of the wastes accommodated within the box pallet, which is applied to engaging portions between the actuation arm and the actuation rod is prevented from being directly applied to the engaging portions, so that the operation for engagement and disengagement between the actuation arm and the actuation rod can be smoothly performed.

(10) With the second invention, preferably, leg portions having a desired height are disposed on a lower side of the box pallet at substantially four corners thereof. A guide wheel is rotatably supported by means of a bracket on one of the bottom plate parts to be opened and closed. A second guide wheel is positioned inwardly of the former guide wheel in facing relationship therewith and is rotatably supported by means of a second bracket on the other of the bottom plate parts. Both guide wheels are positioned within the height of the leg portions.

With this box pallet, when the two divided bottom plate parts are opened and closed, the bottom plate parts are moved to be opened and closed while they are restrained and guided by their respective guide wheels mounted on the two divided bottom plate parts, so that the operation for opening and closing the two divided bottom plate parts can be smoothly excellently performed.

(11) Preferably, the brackets on which the guide wheels are mounted are positioned at the same level as the leg portions when the bottom plate parts are closed.

With this box pallet, the brackets may function as legs, so that the bottom plate parts can be excellently held in the closed position.

BRIEF DESCRIPTION OF THE DRAWINGS

FIG. 8(*b*) is an enlarged sectional view showing the operational state of the actuation rod and the first operation means.

FIG. 13(*b*) is an enlarged sectional view showing the operational state of the actuation rod and the first operation means.

BEST MODES OF EMBODYING THE INVENTION

Figure 1:
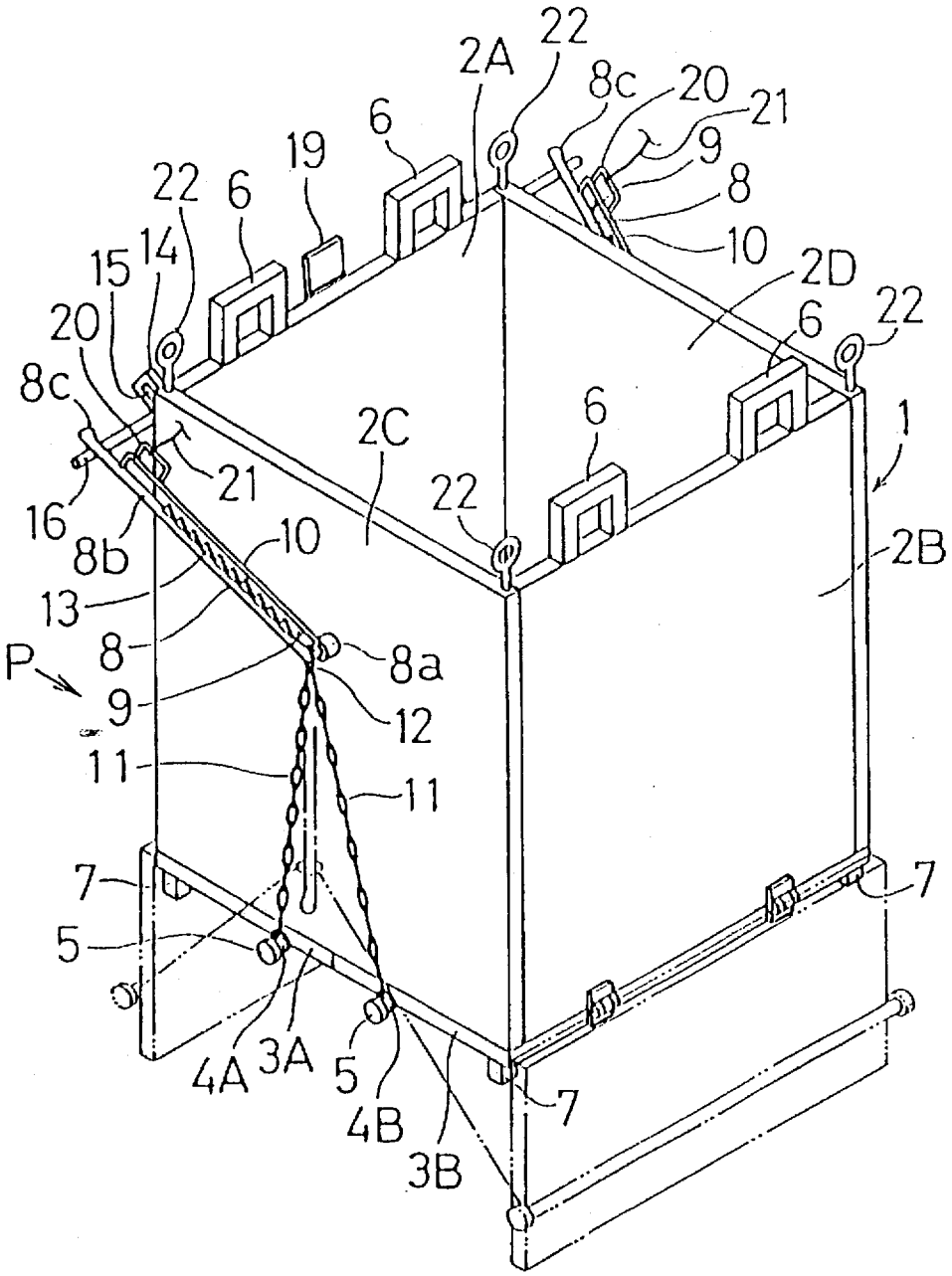
FIG. 1 is a perspective view of a box pallet according to a first embodiment of the present invention.
Figure 2:
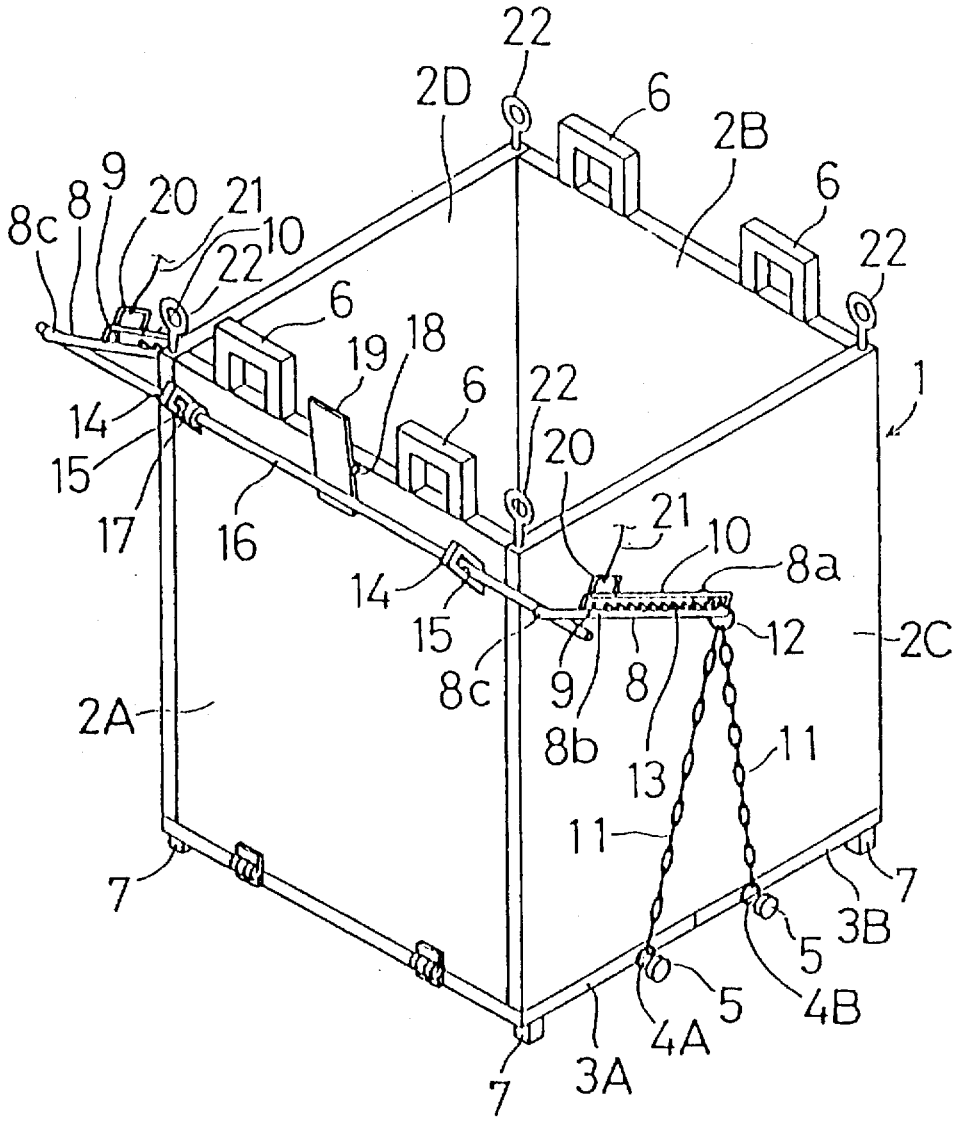
FIG. 2 is a view in the direction of an arrow P in FIG. 1.
Figure 3:
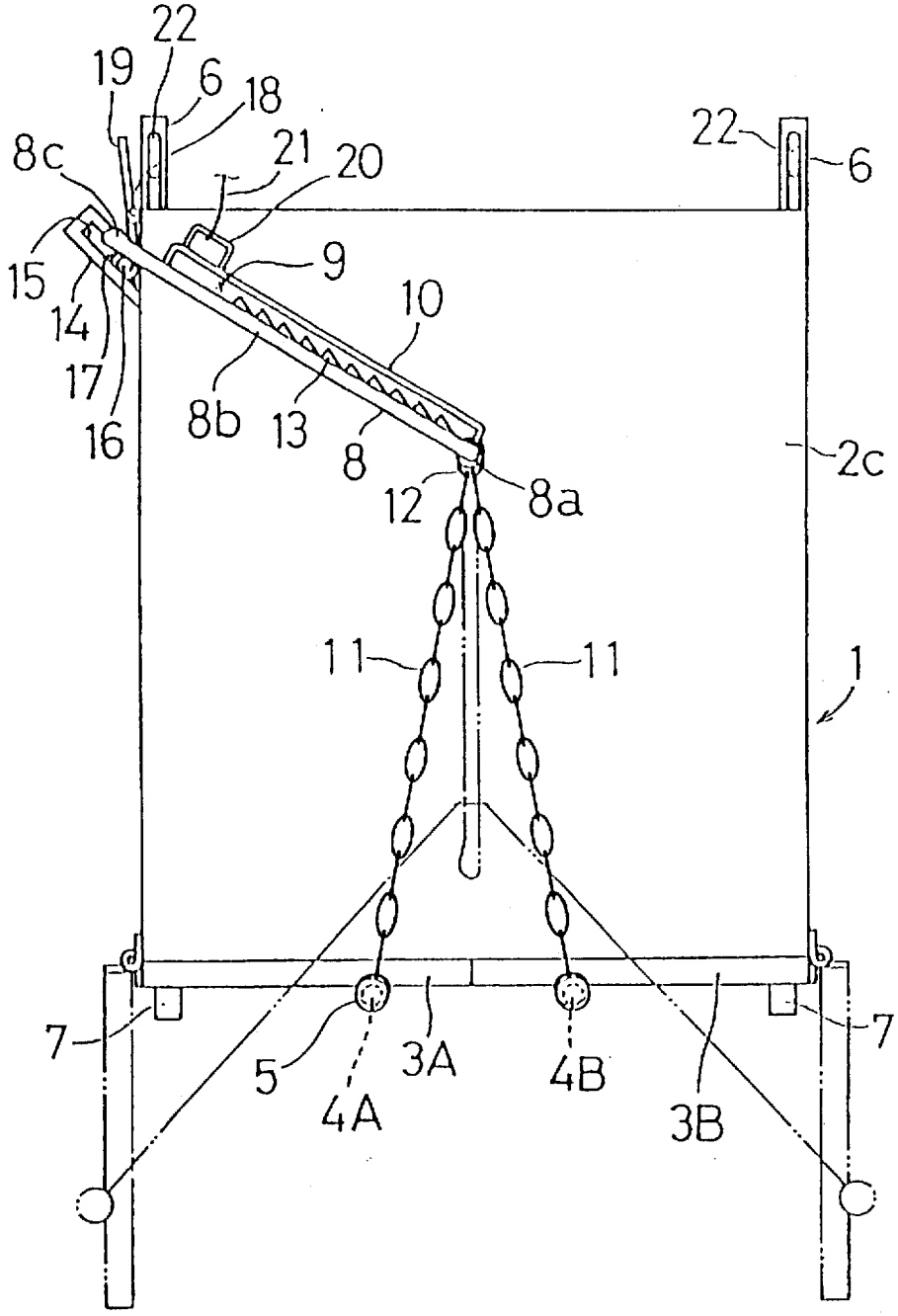
FIG. 3 is a front view.
Figure 4:
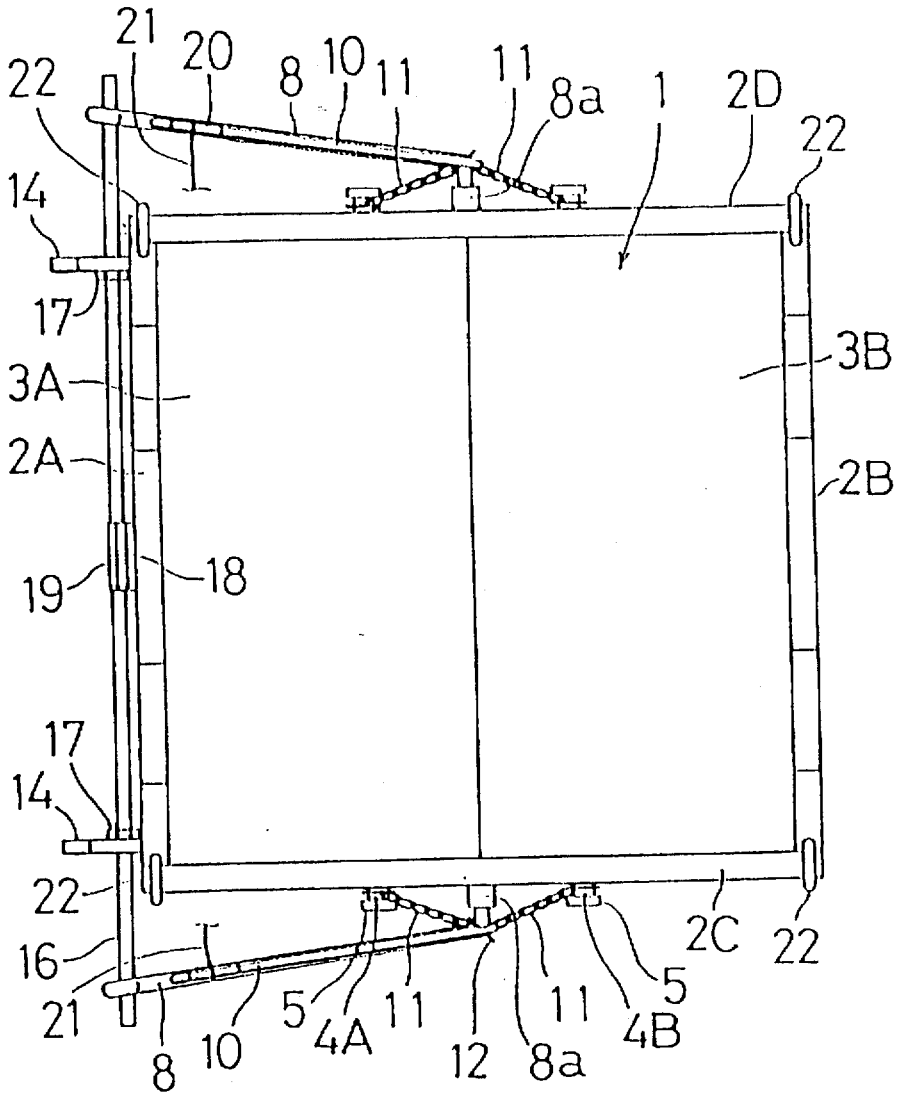
FIG. 4 is a plan view.
Figure 5:
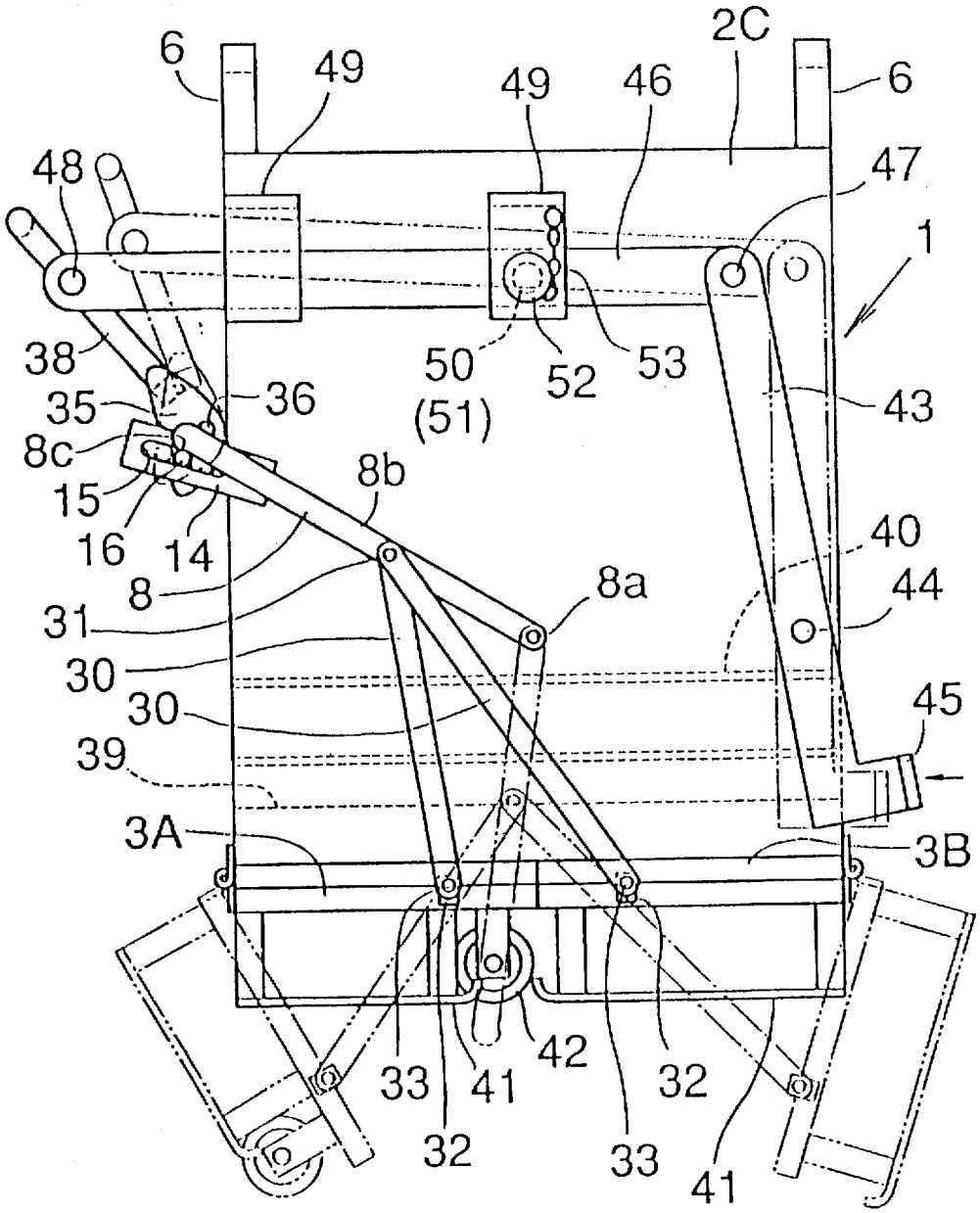
FIG. 5 is a front view of a box pallet according to a second embodiment of the present invention.
Figure 6:
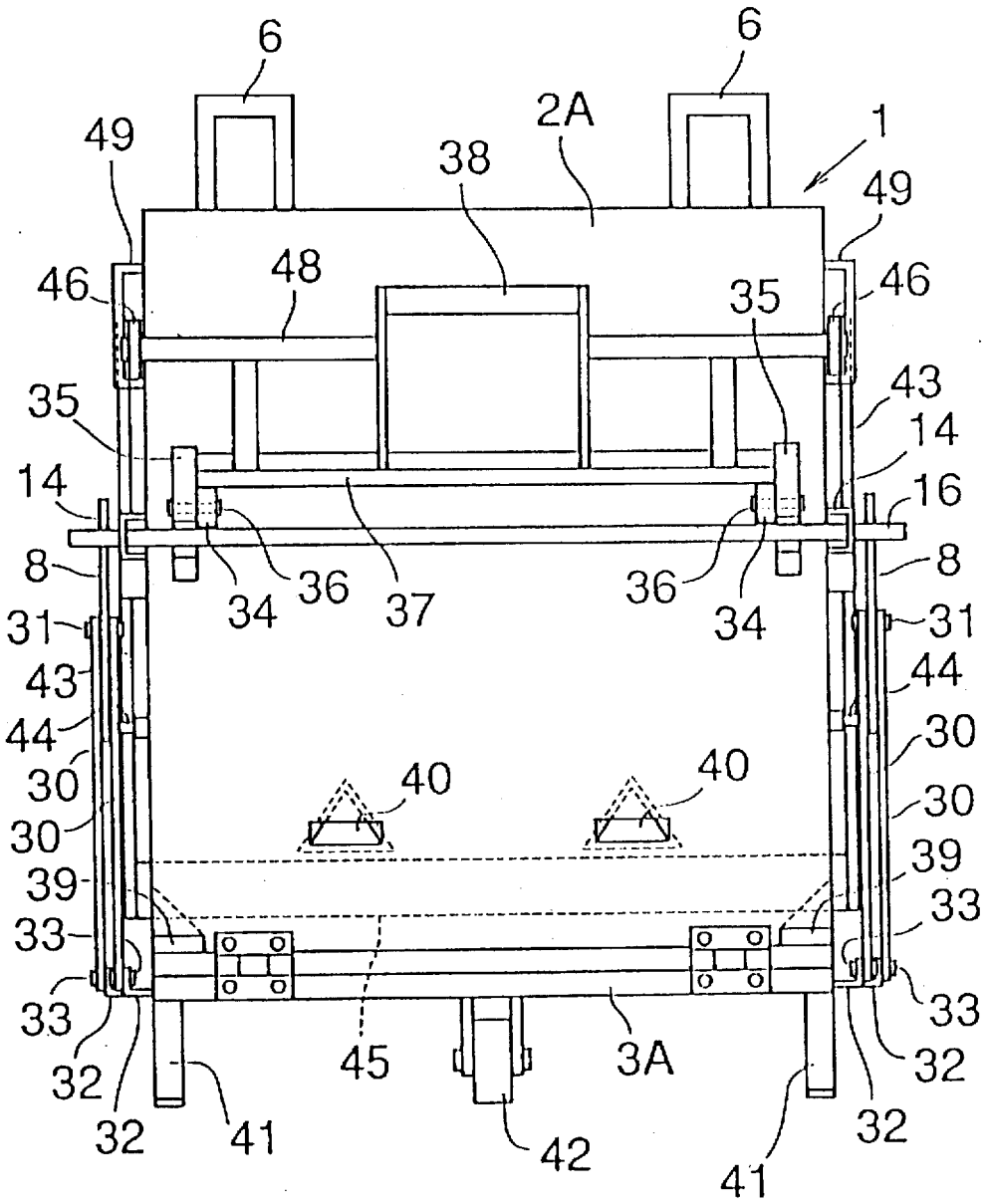
FIG. 6 is a side view.
Figure 7:
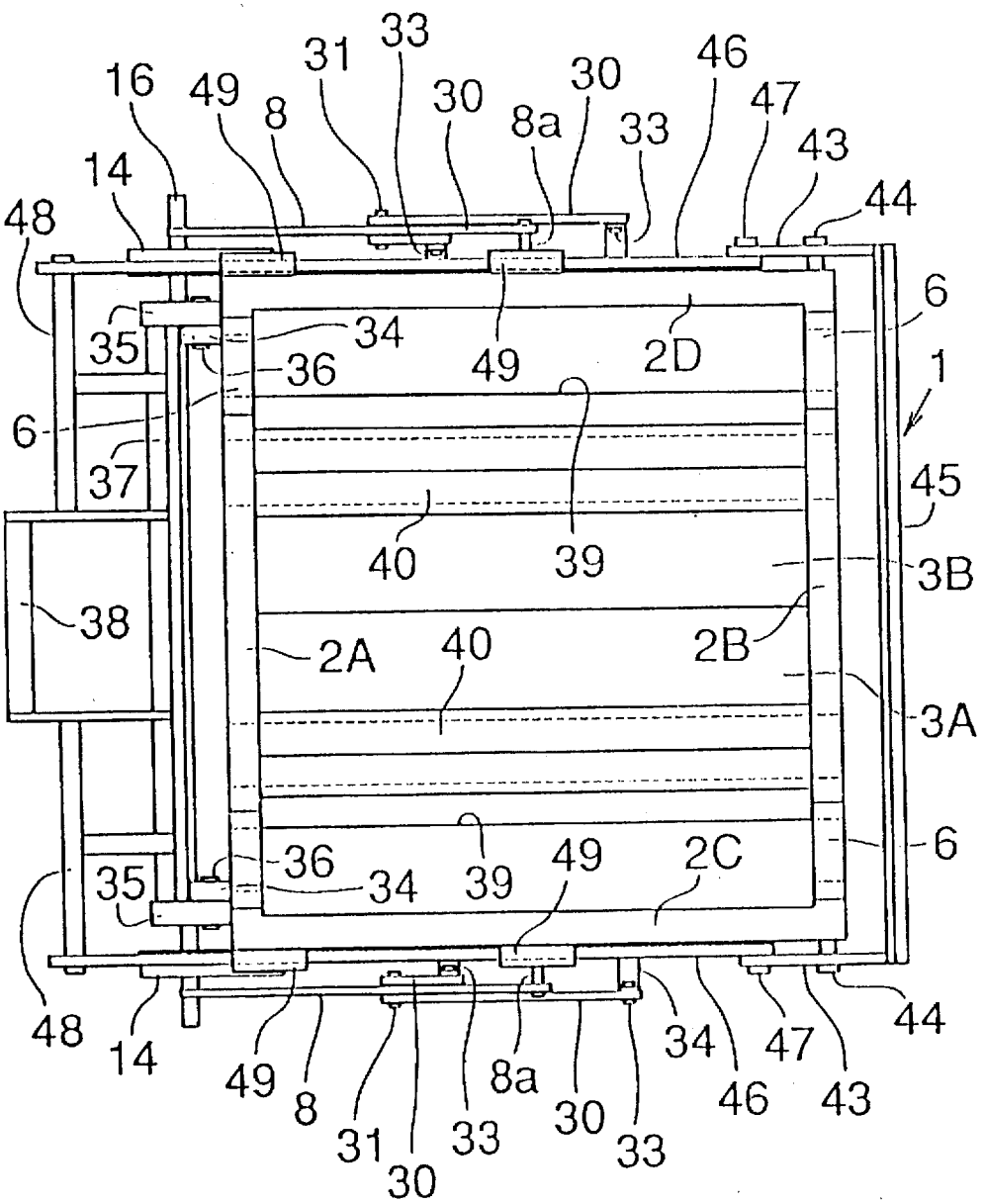
FIG. 7 is a plan view.
Figure 8A:
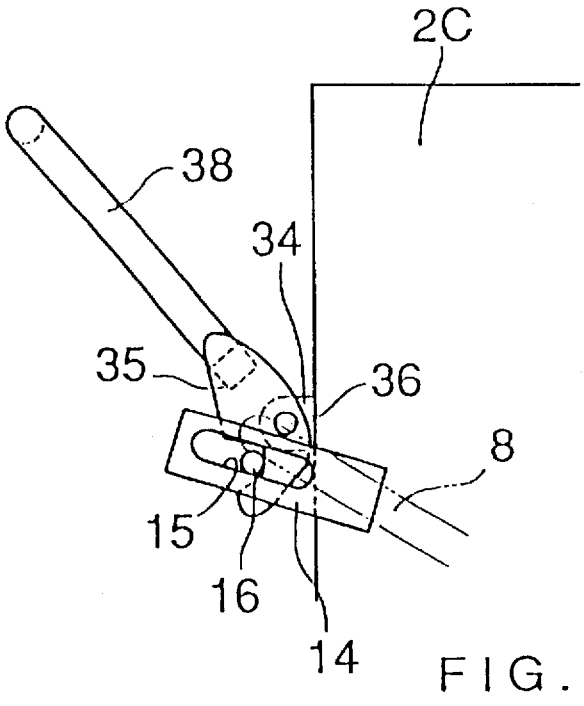
FIG. 8(*a*) is an enlarged sectional view showing the relationship among a mounting plate, an actuation rod and first operation means.
Figure 8B:
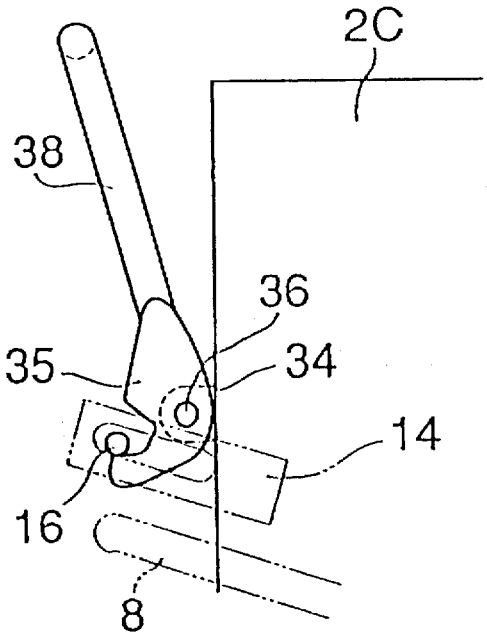
Figure 9:
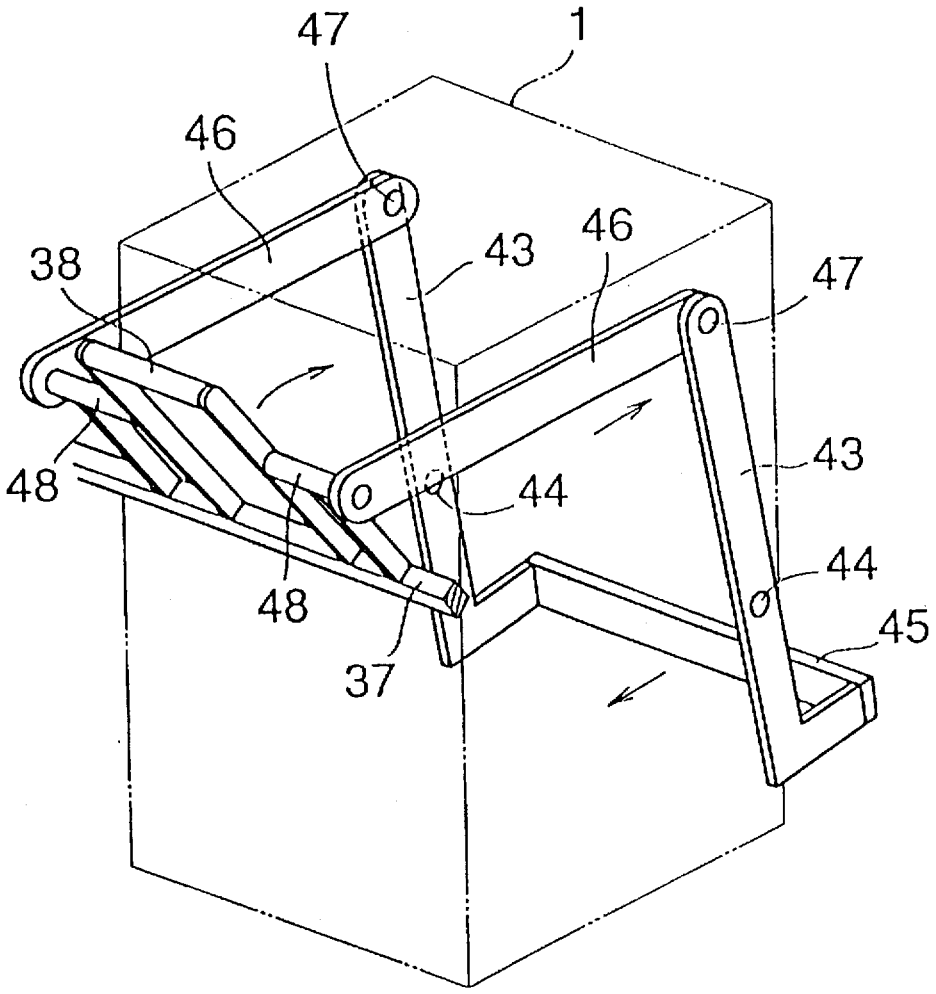
FIG. 9 is a perspective view, with a part omitted, of the related construction of the first operation means and second operation means.
Figure 10:
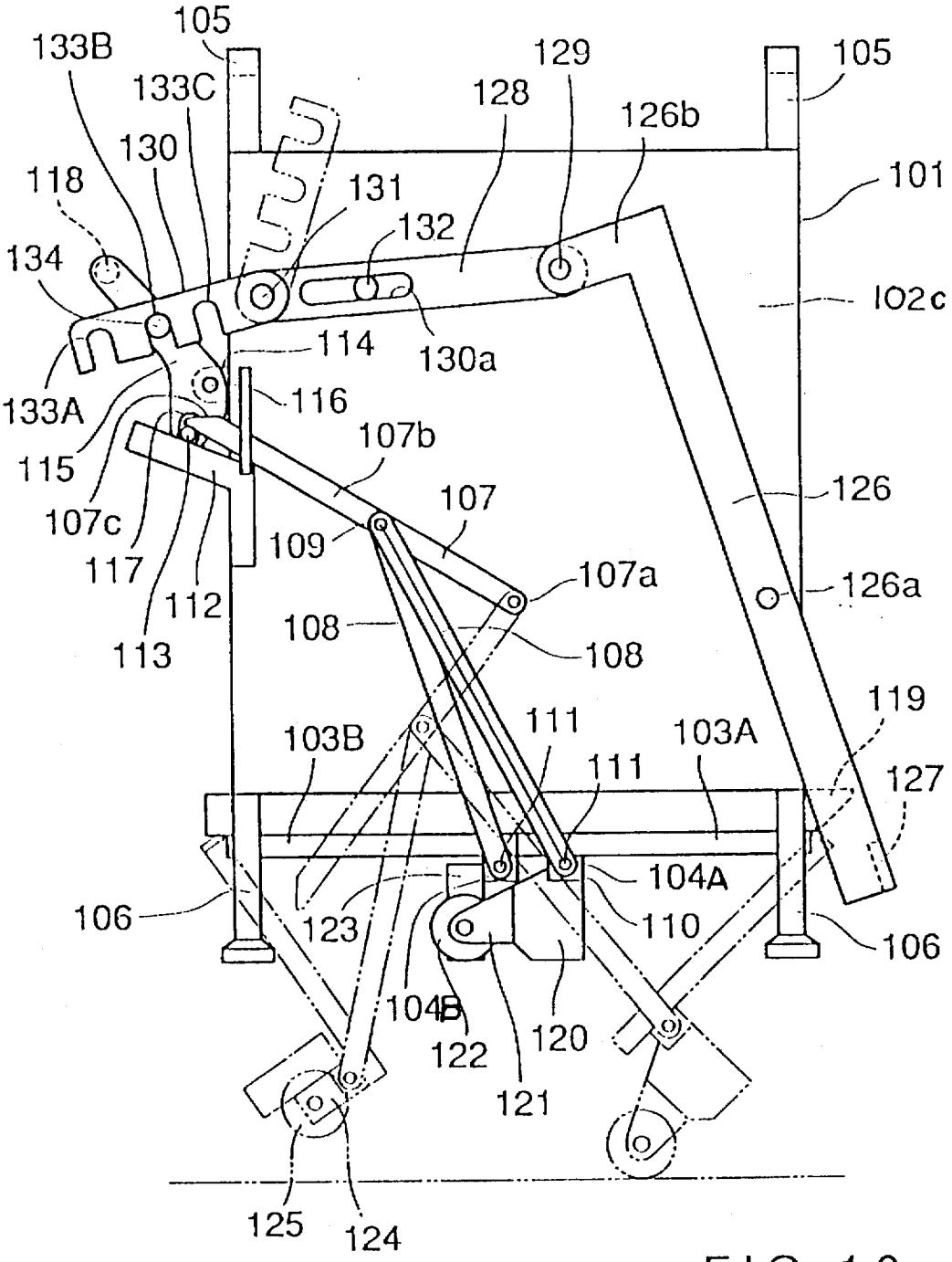
FIG. 10 is a front view of a box pallet according to a third embodiment of the present invention.
Figure 11:
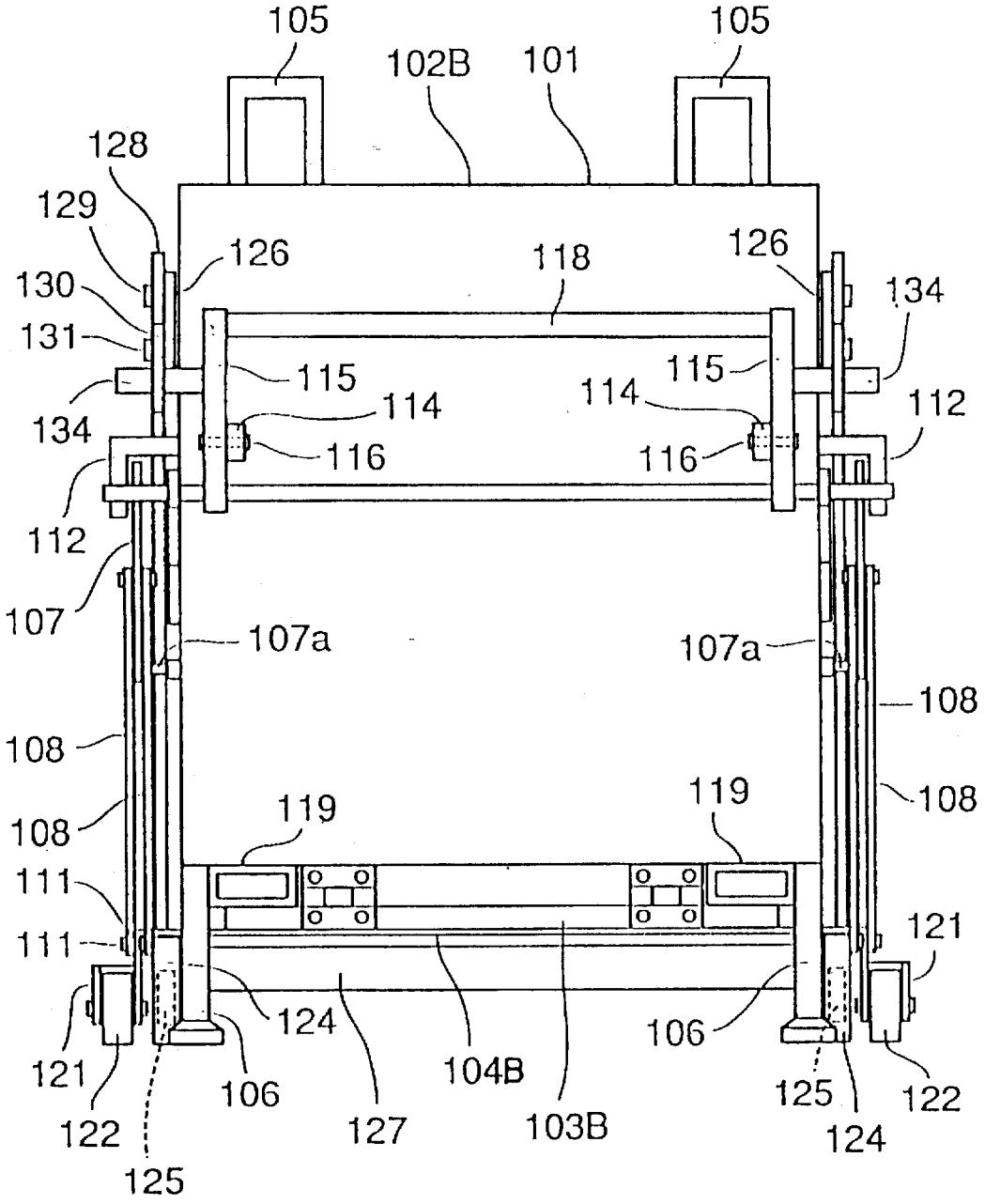
FIG. 11 is a side view.
Figure 12:
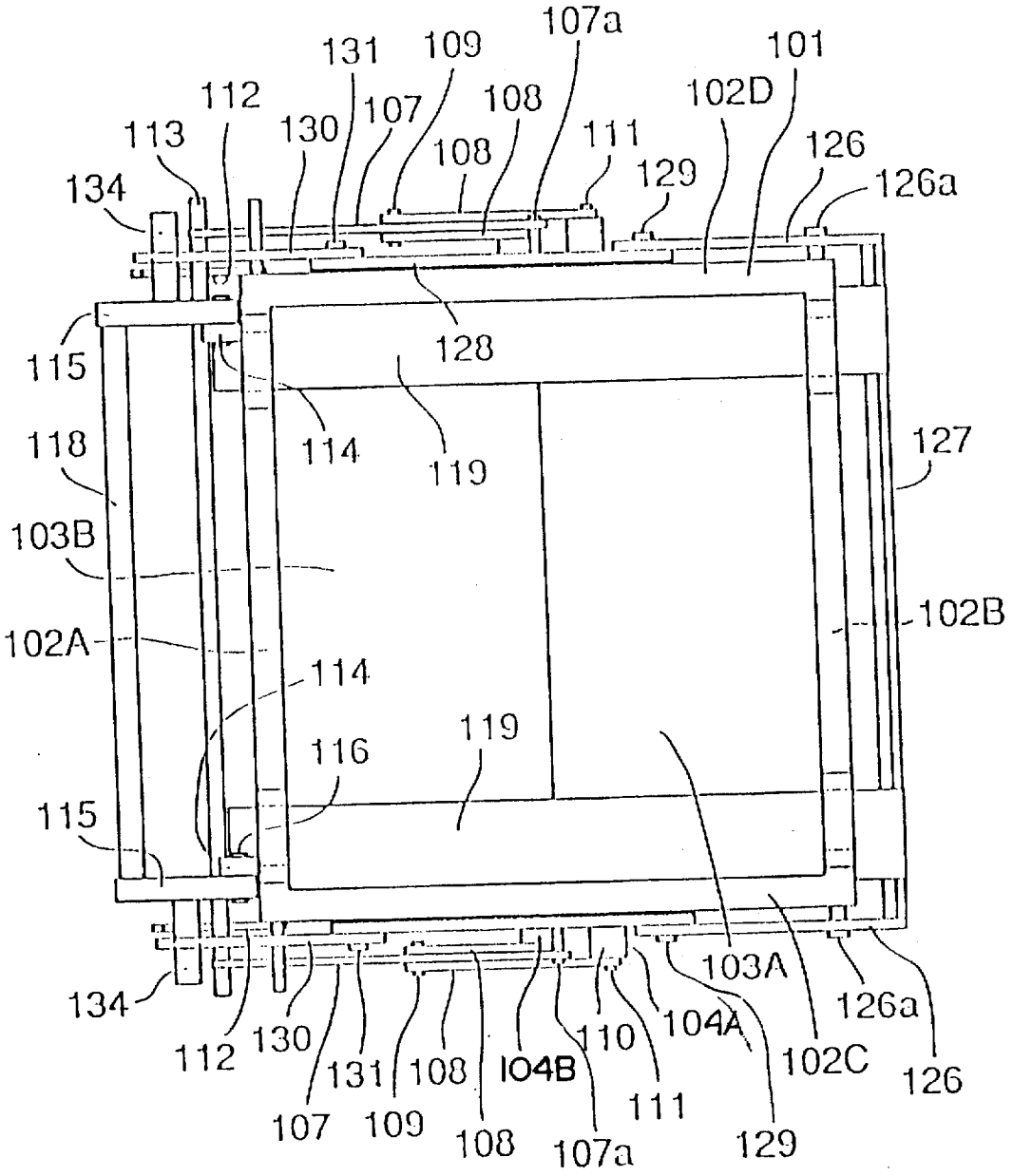
FIG. 12 is a plan view.
Figure 13A:
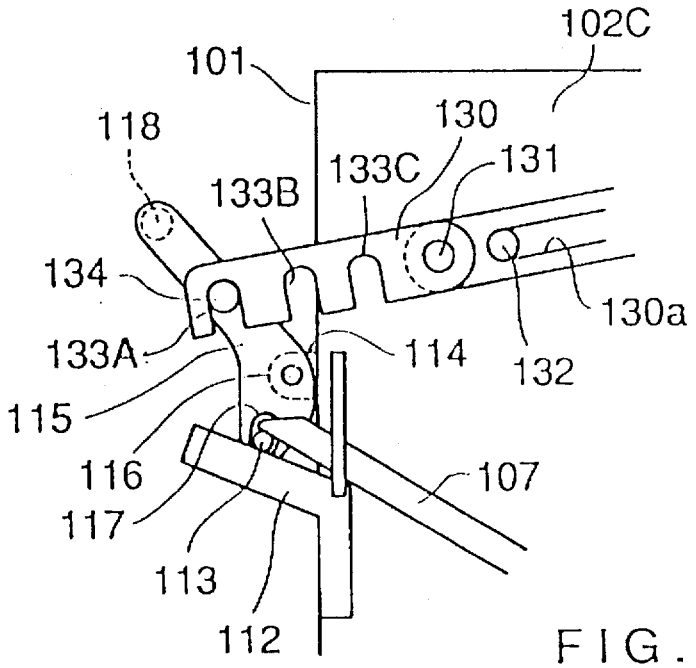
FIG. 13(*a*) is an enlarged sectional view showing the relationship among a mounting plate, an actuation rod and first operation means.
Figure 13B:
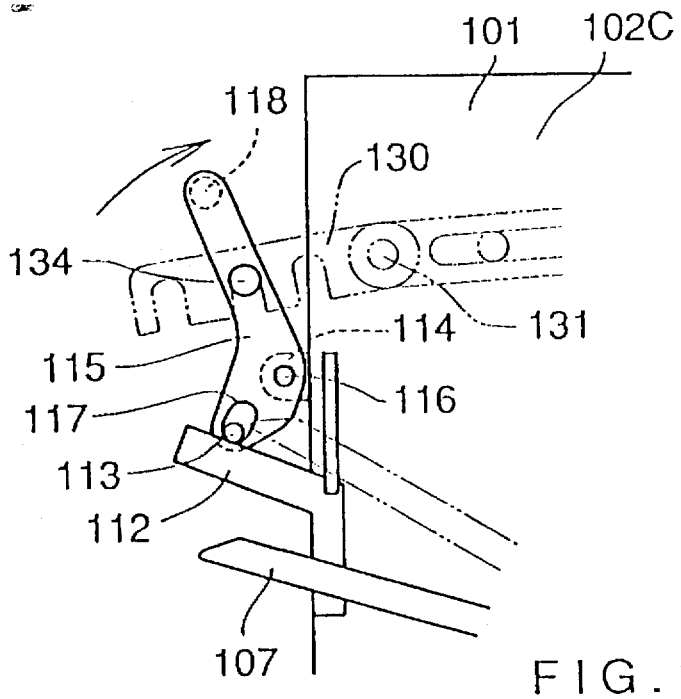
Figure 14:
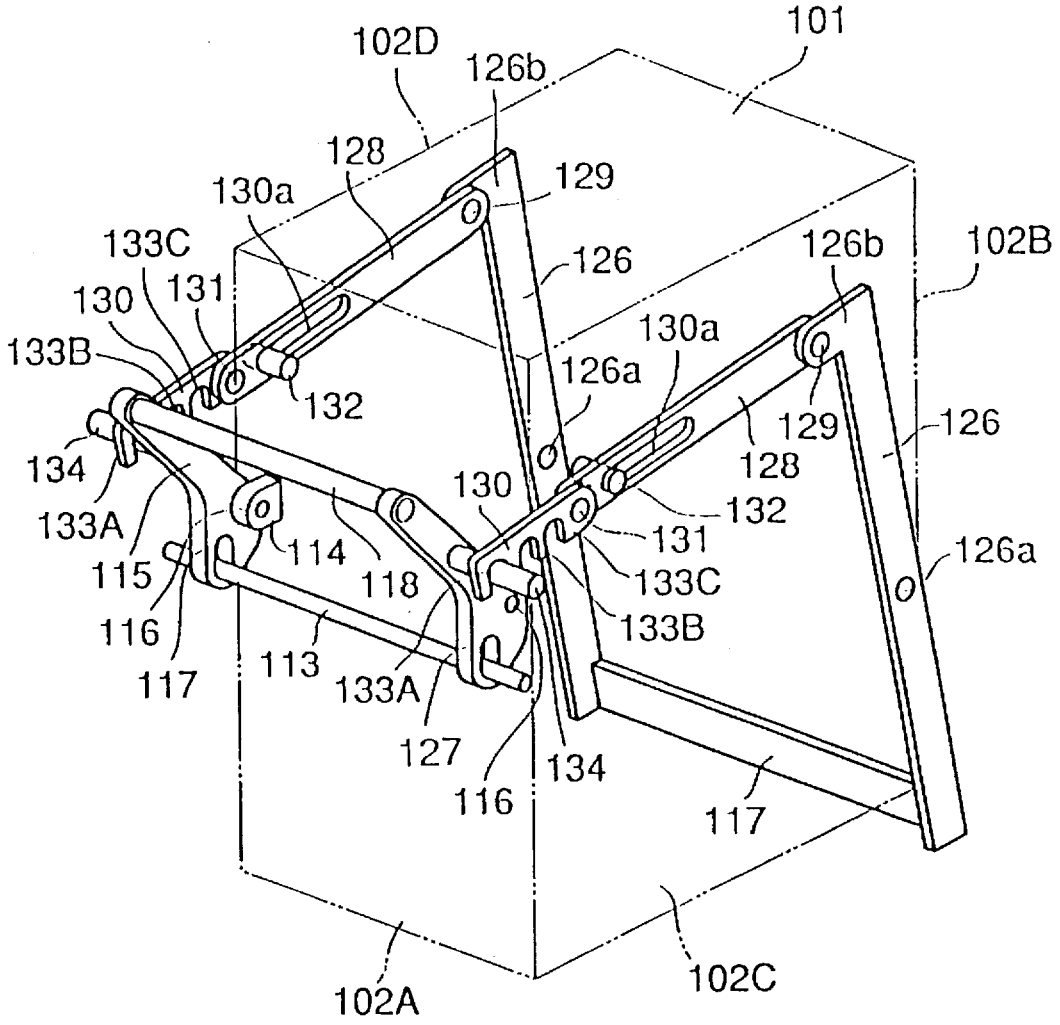
FIG. 14 is a perspective view, with a part omitted, of the related construction of the first operation means and second operation means.

A first embodiment embodying the present invention will now be explained in detail with reference to FIGS. 1 to 4.

In the drawings, numeral 1 generally designates a box pallet, and the box pallet 1 is formed in a box-like configuration having four sides formed by side plates 2A, 2B, 2C and 2D, a bottom divided into two bottom plate parts 3A and 3B at its substantially central portion, and an open top. The bottom plate parts 3A and 3B have edges which are positioned opposite to their dividing edges and are mounted by means of pivotal means such as hinges on the lower portions of the side plates 2A and 2B facing to each other, respectively, for opening and closing movement. Support rods 4A and 4B extend horizontally along the dividing edges. Each of the support rods 4A and 4B has both ends which extend slightly outwardly from their corresponding bottom plate parts 3A and 3B. Guide members 5 are mounted on both ends of each of the support rods 4A and 48. Each of the guide members 5 is sized to be larger than the support rods 4A and 4B and also functions as a damper. Substantially gate-like receptor fittings 6 are mounted on an upper surface of each of the side plates 2A and 2B and are spaced from each other by a predetermined distance for inserting a fork of a fork lift truck, etc. Four support legs 7 having relatively short length are mounted on a lower portion of the side plates 2A and 2B. Damper members made of rubber, etc. are mounted on the side plates 2A and 2B and serve to damp the opening movement of the bottom plate parts 3A and 3B.

On a substantially central portion of each of the side plates 2C and 2D which are positioned in a direction perpendicular to the dividing edges of the bottom plate parts 3A and 3B, an actuation arm 8 is vertically pivotally supported on the corresponding side plate 2C or 2D by means of a boss portion 8*a* and extends along the corresponding side plate 2C or 2D. (Although the following description will be made in connection with the side plate 2C positioned on one side, the same construction is incorporated in connection with the side plate 2D positioned on the other side.) An arm portion 8*b* of the actuation arm 8 has one end which extends slightly beyond one lateral edge of the side plate 2C when the actuation arm 8 is in an upwardly tilted position. The one end of the arm portion 8*b* is expanded to form a desired guide arcuate surface 8*c*. A guide support member 10 is formed integrally with the arm portion 8*b* to form an elongated guide slot 9 which extends from a pivotal support point in a longitudinal direction of the arm portion 8*b*. A support ring 12 for attaching connecting cords 11 made of two chains, etc. is fitted in the elongated guide slot 9 and is movable along the arm portion 8*b*. The connecting cords 11 made of two chains, etc. constituting interlocking members have upper ends connected to the support ring 12 and have lower ends connected to the extended ends of the support rods 4A and 4B of the two divided bottom plate parts 3A and 3B, respectively. The length of the connecting cords 11 is determined such that the support ring 12 is positioned adjacent the pivotal support point of the actuation arm 8 (the boss portion 8*a*) so as to hold the bottom plate parts 3A and 3B in the closed position when the actuation arm 8 is in the upwardly tilted position, and that the support ring 12 is positioned adjacent a remotest position from the pivotal support point of the actuation arm 8 (the boss portion 8*a*) so as to permit the bottom plate parts 3A and 3B to move to the open position for opening the bottom of the box pallet when the actuation arm 8 is in a downwardly tilted position. Here, a saw-toothed like adjusting member 13 is mounted on the arm portion 8*b* of the actuation arm 8, so that the support ring 12 can be moved in a step-by-step manner within the elongated guide slot 9. An actuation cord such as a wire is mounted on the guide support member 10 and will be explained later.

Support brackets 14 extend obliquely from both sides of the upper portion of the side plate 2A which is positioned perpendicular to the side plate 2C, and are spaced from each other by a predetermined distance. Obliquely extending elongated guide slots 15 are formed in the support brackets 14, respectively. An actuation rod 16 having a long length is passed through and between the obliquely extending elongated guide slots 15 and is supported horizontally by them, so that the actuation rod 16 can be moved along the obliquely extending elongated guide slots 15 in a direction away from the side plate 2A. Both ends of the actuation rod 16 extend beyond the lateral edges of the side plate 2A and engage the end portions of the actuation arms 8 in a placed-on fashion so as to hold the actuation arms 8 in the upwardly tilted position when the actuation rod 16 is positioned in the lowermost position within the obliquely extending elongated guide slots 15. As the actuation rod 16 is moved obliquely upwardly (in a direction away from the side plate 2A) along the obliquely extending elongated guide slots 15 to the uppermost position within the obliquely extending elongated guide slots 15, the engagement in the placed-on fashion of the ends of the actuation arms 8 is released so as to permit the actuation arms 8 to be pivoted downwardly. A position limiting flange 17 is mounted on the actuation rod 16 and serves to abut on the support brackets 14 for preventing the actuation rod 16 from moving in its longitudinal direction (axial direction of the rod) relative to the obliquely extending elongated guide slots 15.

A plate-like operation member 19 constituting first operation means is pivotally supported on an upper portion of the side plate 2A at the substantially central position thereof by means of a bracket 18. The operation member 19 has an upper end extending slightly beyond the upper end surface of the side plate 2A, and has a lower end positioned in facing relationship with a shaft portion of the actuation rod 16. Thus, the operation member 19 is so constructed as to be operable to move the actuation rod 16 obliquely upwardly (in a direction away from the side plate 2A) from the lowermost position within the obliquely extending elongated guide slots 15 to the uppermost position within the obliquely extending elongated guide slots 15 when the operation member 19 is pivoted in a clockwise direction in FIG. 1.

Here, the operation member 19 is normally biased to pivot in a counterclockwise direction in FIG. 1 by means such as a coil spring (not shown) coiled around a pivotal shaft portion of the operation member 19.

A substantially gate-like receptor portion 20 is formed integrally with the upper portion of the guide support member 10 of each of the actuation arms 8. Actuation cords 21 such as wires are adapted for opening the bottom plate parts 3A and 3B, and each actuation cord 21 has one end connected to the corresponding receptor portion 20 while bypassing the actuation rod 16.

Thus, the actuation cords 21 are adapted to be engaged and hung up by a fork of a fork lift truck for closing the bottom plate parts 3A and 3B. The actuation cords 21 may be replaced by any different members which are constructed to be engaged with the receptor portions 20.

Further, engaging members 22 each in the form of an eye bolt are mounted on the upper surface of the box pallet 1 at substantially four corners thereof, so that the box pallet 1 may be hung up by a crane, etc. by engaging drawing cords such as wires (not shown) with the engaging members 22.

The box pallet 1 of this embodiment is constructed as described above and is adapted to accommodate desired articles such as wastes which are put into the box pallet 1 from upside thereof when the two divided bottom plate parts 3A and 3B are in their closed position.

The description will now proceed in connection with an operation for taking out the accommodated articles such as wastes from the box pallet 1. First, a fork of a fork lift truck, etc. is inserted into the receptor fittings 6, so that, by the fork lift truck, etc., the whole box pallet 1 is hung up and moved to a predetermined position such as a position above a load-carrying platform of a truck for conveying the articles such as wastes. With the box pallet 1 in this position, an operator pivots the operation member 19 in a clockwise direction in the drawings against the biasing force of the spring (not shown). As the operation member 19 is thus pivoted, the actuation rod 16 is moved obliquely upwardly (in the direction away from the side plate 2A) along the obliquely extending elongated guide slots 15 of the support brackets 14 from the lowermost position within the obliquely extending elongated guide slots 15 to the uppermost position within the obliquely extending elongated guide slots 15.

As the actuation rod 16 is moved to the uppermost position within the obliquely extending elongated guide slots 15, the engagement in the placed-on fashion of the ends of the actuation arms 8 which has been obtained by that time is automatically released, so that the downward pivotal movement of the actuation arms 8 is permitted. Then, the actuation arm 8 is pivoted downwardly by gravity (pivoted downwardly along the side plate 2C), and with this movement, the support ring 12 on which the connecting cords 11 are attached is therefore moved in such a manner that the support ring 12 moves along the elongated guide slot 9 toward a position adjacent the remotest position from the pivotal support portion (the boss portion 8*a*) of the operational arm 8 while getting over each saw-toothed portion of the adjusting member 13. The connecting cords 11 themselves are therefore loosened at their connecting positions with the bottom plate parts 3A and 3B so as to permit the bottom plate parts 3A and 3B to be opened.

By virtue of the engagement of the support ring 12 with each saw-toothed portion of the adjusting member 13 within the elongated guide slot 9, the moving speed of the support ring 12 is buffered, and the pivotal position of the actuation arm 8 can be adjusted in a step-by-step manner. In case of the latter, it is desirable that means is provided for temporarily holding the actuation arm 8 so as to keep the pivotal position of the actuation arm 8.

When the pivotal force applied to the operation member 19 is released after releasing the engagement between the actuation rod 16 and the actuation arm 8, the operation member 19 is automatically pivoted to its original position in the counterclockwise direction in the drawings against the biasing force of the spring (not shown), and the actuation rod 16 returns to the lowermost position within the obliquely extending elongated guide slots 15 by gravity.

Then, the bottom plate parts 3A and 3B are moved to be opened on both sides around the relevant portions of the pivotal means such as hinges (opened like a double-leafed hinged door) by their gravity and by the gravity of the accommodated articles such as waste, so that the box pallet 1 itself is opened at its bottom and that the articles such as wastes accommodated within the box pallet 1 can be taken out therefrom.

In this case, when the bottom plate parts 3A and 3B are vigorously moved to be opened, the damper members made of rubber etc. absorb the impacts on the side plates 2A and 2B. Further, when the box pallet 1 abuts on the load carrying platform of the truck, etc., because of shortage of lifting height of the box pallet 1 itself, the impacts can be absorbed by the guide members 5 which are mounted on the support rods 4A and 4B and function as dampers.

When the actuation cord 21 is engaged by another hanging-on means and is lifted upwardly upon completion of the operation for taking out the articles such as wastes accommodated within the box pallet 1 as described above, the actuation arm 8 is positively pivoted upwardly (pivoted upwardly along the side plate 2C), and with this pivotal movement, the support ring 12 on which the connecting cords 11 are attached is moved in such a manner that the support ring 12 moves along the elongated guide slot 9 toward the position adjacent the pivotal support portion (the boss portion 8*a*) of the actuation arm 8 while getting over each saw-toothed portion of the adjusting member 13. The connecting cords 11 themselves are therefore held in a normally tensioned state at their connecting positions with the bottom plate parts 3A and 3B so as to pull up the bottom plate parts 3A and 3B for closing the same (pivotal closing movement).

As the above operation is continued, the actuation rod 16 at the lowermost position within the obliquely extending elongated guide slots 15 is pushed obliquely upwardly along the obliquely extending elongated guide slots 15 by the guide arcuate surface 8*c* of the one end of the actuation arm 8, while causing no interference with the actuation rod 16, and the actuation rod 16 is again moved to return to the lowermost position within the obliquely extending elongated guide slots 15, so that the one end of the actuation arm 8 is automatically engaged by the actuation rod 16 and that the actuation arm 8 is held in the upwardly tilted position. Simultaneously with this operation, two divided bottom plate parts 3A and 3B are pulled up toward the closed position (pivoted to be closed) and are completely closed, so that the bottom of the box pallet 1 itself is closed.

The box pallet 1 itself is thereafter moved to its predetermined original position and the fork of the fork lift truck, etc. is removed from the receptor fittings 6.

In this embodiment, since the connecting cords 11 such as chains connect the bottom plate parts 3A and 3B with the actuation arm 8 which performs an opening and closing control of the bottom plate parts 3A and 3B through engagement with and disengagement from the actuation rod 16 in response to the pivotal movement of the operation member 19, the opening and closing operation of the bottom plate parts 3A and 3B can be positively performed by the upward and downward pivotal movement of the actuation arm 8.

Although the above embodiment has been described in connection with the case that the box pallet 1 itself is hung up by the fork lift truck, etc. through insertion of the fork of the fork lift truck, etc. to the receptor fittings 6, the box pallet 1 can be hung up by the fork of the fork lift truck, etc. or a crane by engaging drawing cords such as wires (not shown) with the eye bolt-like engaging members 22 positioned at substantially four corners of the upper surface of the box pallet 1. If the crane is adapted for hanging up, pulling cords such as ropes and wires for the purpose of operation at a remote position may be attached to the operation member 19, so that the operation member 19 is pivoted by pulling the pulling cords. In this case, the hanging up operation of the box pallet 1 and the opening and closing operation of the bottom plate parts 3A and 3B can be performed by operation at the remote position, so that the safety and the labor-saving effect can be further improved.

A second embodiment of the present invention will now be explained.

As shown in FIGS. 5 to 9, in place of the connecting cords 11 of the first embodiment, this embodiment incorporates operational link means as interlocking means between the actuation arm 8 and the bottom plate parts 3A and 3B. Further, this embodiment includes automatic operation means for automatically performing the opening and closing operation of the two divided bottom plate parts 3A and 3B in addition to the manual operation by the operator. In the drawings, the same numerals are affixed to the same construction or components as the first embodiment, and the detailed explanation of these construction or components are omitted.

More specifically, at positions below substantially central portions of the side plates 2C and 2D which are positioned perpendicular to the dividing edges of the bottom plate parts 3A and 3B, the actuation arms 8 are supported at 8*a* for vertical pivotal movement along the side plates 2C and 2D, respectively. When the actuation arms 8 are in their upwardly tilted position, one end of the arm portion 8*b* of each actuation arm 8 extends slightly beyond the edge of the side plate 2C, and the one end is expanded to form the desired circular arcuate surface 8*c*. Two operational links 30 constituting interlocking means and having a length different from each other are disposed obliquely and supported by a common pivotal support pin 31 at a position adjacent the one end of the arm portion, so that the operational links 30 are vertically pivotally movable along the side plates 2C and 2D, respectively. Lower portions of the actuation links 30 are pivotally connected to divided-side portions of the aforementioned two divided bottom plate parts 3A and 3B by means of pivotal support pins 33 for permitting pivotal movement via brackets 32, respectively.

The support brackets 14 extend obliquely from both sides of the substantially upper portion of the side plate 2A positioned on one side, and the support brackets 14 have the obliquely extending elongated guide slots 15 formed therethrough, respectively. The actuation rod 16 is passed through and between the obliquely extending elongated guide slots 15 and supported horizontally by them. More specifically, both ends of the actuation rod 16 are inserted into the obliquely extending elongated guide slots 15 and extend outwardly therefrom such that they are movable along the obliquely extending elongated guide slots 15 in a direction away from the side plate 2A or in a direction to move on and away from the pivotal locus of one end of the actuation arm 8.

On both sides of the substantially upper portion of the side plate 2A positioned on one side and perpendicular to the side plate 2C, substantially triangular mounting plates 35 are pivotally supported by mounting brackets 34, respectively, and are positioned in spaced relationship with each other by a predetermined distance. One of the upper corner portions of each of the mounting plates 35 is pivotally supported by the bracket 34 by means of a pivotal pin 36, and the lower corner portion of each of the mounting plates 35 is formed with an engaging slot 35*a* having a substantially horizontally oriented U-shaped configuration for inserting the actuation rod 16. The other of the upper corner portions of each of the mounting plates 35 supports a mounting rod 37 in a horizontal position. A gate-like operation member 38 constituting first operation means is obliquely mounted on the mounting rod 37 such that the upper portion of the operation member 38 extends slightly beyond the upper surface of the box pallet 1.

Thus, by pivoting the operation member 38 in a direction toward the side plate 2A, the mounting plates 35 are pivoted around the pivot pins 36 as their fulcrums, respectively. As the mounting plates 35 are thus pivoted, both ends of the actuation rod 16 which are inserted into the engaging slots 35*a* are moved along the obliquely extending elongated guide slots 15 in the direction away from the side plate 2A or in the direction away from the pivotal locus of the end of the actuation arm 8. On the other hand, by the pivotal movement of the operation member 38 in a direction away from the side plate 2A by its gravity, the mounting plates 35 are pivoted around the pivot pins 36 as their fulcrums. As the mounting plates 35 are thus pivoted, both ends of the actuation rod 16 are moved along the obliquely extending elongated guide slots 15 in the direction toward the side plate 2A or in the direction toward a position on the pivotal locus of the end of the operational arm 8. When both ends of the actuation rod 16 are at the lowermost position within the obliquely extending elongated guide slots 15 and extend beyond the lateral edges of the side plate 2A, respectively, they are on the pivotal locus of the end of the actuation arm 8 and engage the end of the operational arm 8 for holding the upwardly tilted position of the actuation arm 8. As both ends of the actuation rod 16 are moved obliquely upwardly (in the direction away from the side plate 2A) toward the uppermost position within the obliquely extending elongated guide slots 15 along the obliquely extending elongated guide slots 15, both ends of the actuation rod 16 are moved away from the pivotal locus of the end of the actuation arm 8 so as to release the engagement with the end of the actuation arm 8 and to permit downward pivotal movement of the actuation arm 8.

Hollow first fork insertion members 39 each having a substantially triangular configuration in section for receiving a fork of a fork lift truck, etc. are disposed on both lateral sides of the lower portion of the box pallet 1 in spaced relationship from each other by a predetermined distance and extend between side plates 2A and 2B which are perpendicular to the side plate 2C. Second fork insertion members 40 are disposed substantially above the first fork insertion members 39 and are positioned in spaced relationship with each other by a predetermined distance similar to the first fork inserting members 39. The forks of the fork lift truck, etc. are inserted into the fork inserting members 39 and 40 for lifting and lowering the whole box pallet 1.

Further, sleigh-like legs 41 each having a predetermined height are vertically mounted on both lateral edges of the lower surface of the two divided bottom plate parts 2A and 2B. One rotatable guide wheel 42 is mounted on the lower surface of the bottom plate part 2A positioned on one side. The position of the guide wheel 42 is determined such that its peripheral portion is positioned in flush with the lower surfaces of the legs 41 or is positioned slightly inwardly thereof.

The construction will now be explained in connection with automatic operation means constituting second operation means for automatically performing the opening and closing operation of the two divided bottom plate parts 3A and 3B.

A pivotal lever 43 is disposed vertically along one of the lateral edges of each of the side plates 2C and 2D. The substantially central portion of the pivotal lever 43 is pivotally supported on the corresponding side plates 2C or 2D by means of a support pin 44. The pivotal lever 43 has an upper end extending to the substantially upper portion of the box pallet 1 and has a lower end extending to the lower portion of the box pallet 1 or a position below the first fork insertion members 39. An abutting plate 45 connects the lower portions of the pivotal levers 43 to each other and extends horizontally along the side plate 2B positioned on the other side. Connecting arms 46 are disposed on the substantially upper portions of the side plates 2C and 2D and extend horizontally along the side plates 2C and 2D, respectively. Each of the connecting arms 46 has one end pivotally supported on the corresponding pivotal lever 43 by means of a pin 47 and has the other end connected to the operation member 38. More specifically, connecting rods 48 are mounted on both sides of the operation member 38 and extend toward the side plate 2C and 2D, respectively, and the other end of the connecting arm 46 is fixedly connected to the corresponding connecting rod 48. The connecting rod 48 is reinforced by a reinforcing member which extends from the upper portion of the corresponding mounting plate 35.

Thus, with the above automatic operation means, when the abutting plate 45 of the pivotal levers 43 is pushed to be moved toward the side plate 2B, the pivotal levers 43 are pivoted about the support pins 44, respectively, in the clockwise direction in the drawings, so that the upper end of the abutting plate 45 is pivotally shifted toward the lateral edge surface of the side plate 2C. With this movement, the connecting arms 46 are linearly moved in parallel while being pulled rightwardly in the drawings, so that the operation member 38 connected integrally with the connecting arms 46 by means of connecting rods 48 is pivoted toward the side plate 2A. The placed-on relationship between the actuation rod 16 and the end of the actuation arm 8 is then released in the same manner as described above, so that the actuation arm 8 is permitted to be downwardly pivoted.

The substantially central portion and the substantially other end of each of the connecting arms 46 are guided for parallel movement by guide members 49 having a substantially U-shaped configuration in section and fixed to the side plates 2C and 2D, respectively. The guide member 49 positioned at the central portion has an engaging hole 50 formed therethrough. Another engaging hole 51 is formed through the corresponding connecting arm 46 at a position facing to the engaging hole 50 in a state prior to pulling in the rightward direction in the drawings for the linear parallel movement (the state prior to pivotal movement of the operation member 38 toward the side plate 2A or the closed state of the two divided bottom plate parts 3A and 3B). A removable stopper pin 52 is inserted through and between the engaging hole 50 of the guide member 49 and the engaging hole 51 of the connecting arm 46. The stopper pin 52 is hung down from the guide member 49 by means of a connecting cord 53 such as a chain. When the stopper pin 52 is inserted through and between the engaging hole 50 of the guide member 49 and the engaging hole 51 of the connecting arm 46, the stopper pin 52 prevents the connecting arm 46 from linear parallel movement in the rightward direction in the drawings. When the stopper pin 52 is removed from the engaging holes 50 and 51, the connecting arms 46 are permitted to move linearly in parallel in the rightward direction in the drawings. Thus, the stopper pin 52 serves as safety means for the automatic operation means and also as safety means for preventing the operation member 19 from an accidental operation.

The construction of other parts is the same as the first embodiment.

This embodiment is constructed as described above and the operation of this embodiment is explained hereinbelow.

In this embodiment, first, the stopper pin 52 inserted through and between the engaging hole 50 of the guide member 49 and the engaging hole 51 of the connecting arm 46 is removed from the engaging holes 50 and 51. The fork of the fork lift truck, etc. is inserted into the receptor fittings 6, the first fork insertion members 39 or the second fork insertion members 40 positioned substantially at the lower portion of the box pallet 1, so that the whole box pallet 1 is hung up by the fork lift truck, etc. and is moved at a predetermined position such as the position above the load-carrying platform of the truck for conveying the articles such as wastes.

The operation member 38 is then pivoted toward the side plate 2A by the operator, or the operation member 38 is pivoted toward the side plate 2A by the automatic operation means. In order to pivot the operation member 38 toward the side plate 2A by the operation member 38, the whole box pallet 1 is positioned slightly below an upper portion of a side panel (not shown) of the truck and is pulled toward the side panel of the truck. The abutting plate 45 of the pivotal levers 43 constituting the automatic operation means is then brought to abut on the side panel of the truck and is pushed toward the side plate 2B of the box pallet 1, so that the pivotal levers 43 are pivoted around their corresponding support pins 44 in the clockwise direction in the drawings, resulting in that the upper end of each of the pivotal levers 43 is pivoted and shifted toward the lateral edge surface of the side plate 2C. The connecting arms 46 are therefore linearly moved in parallel along the guide members 49 while being pulled in the rightward direction in the drawings, so that the operation member 38 connected integrally with the connecting arms 46 by means of the connecting rods 48 is pivoted toward the side plate 2A.

As the operation member 38 is pivoted toward the side plate 2A as described above, the mounting plates 35 are pivoted around the pivot pins 36 as fulcrums, respectively. With the pivotal movement of the mounting plates 35, the actuation rod 16 inserted into the engaging slots 35*a* is moved along the obliquely extending elongated guide slots 15 of the support brackets 14 from the lowermost position within the obliquely extending elongated guide slots 15 to the uppermost position therewithin in a direction obliquely upwardly (in the direction away from the side plate 2A) or in the direction away from the pivotal locus of the end of the actuation arm 8, As the actuation rod 16 is moved toward the uppermost position within the obliquely extending guide slots 15, the placed-on engagement with the end of the actuation arm 8 is automatically released to permit the downward pivotal movement of the actuation arm 8. Then, the actuation arm 8 is pivoted (in the counterclockwise direction in the drawings) to the downwardly tilted position (downwardly pivoted position along the side plate 2C) by its gravity, etc., and through interlocking with such pivotal movement, the actuation links 30 are operated to be gradually shifted downwardly for positively opening the bottom plate parts 3A and 3B, respectively. With the operation of the actuation links 30, the bottom plate parts 3A and 3B are pivoted around the portions of the hinges, etc. relative to the side plates 2A and 2B, respectively, so as to be opened in the directions toward both lateral sides (to be opened like a double-leafed hinged door) by their gravity multiplied by the weight of the accommodated articles such as wastes, so that the bottom of the box pallet 1 itself is opened. The articles such as wastes accommodated within the box pallet 1 are thus taken out therefrom.

When the whole box pallet 1 is moved downwardly with the sleigh-like legs 41 of the bottom plate parts 3A and 3B being in abutment on a placing surface after the articles such as wastes accommodated within the box pallet 1 have been taken out, with the downward movement of the box pallet 1, the sleigh-like legs 41 of the bottom plate parts 3A and 3B are positively pivoted toward the closed position so as to close the bottom of the box pallet 1 while maintaining the abutting relationship with the placing surface. In this case, the guide wheel 42 mounted on the bottom plate part 3A on one side provides an aid for an excellent (smooth) pivotal movement of the bottom plate part 3A (3B).

With the positive pivotal movement of the bottom plate parts 3A and 3B toward the closed position, the actuation links 30 are shifted upwardly to pivot the actuation arm 8 in the clockwise direction in the drawings. The actuation rod 16 at the lowermost position within the obliquely extending elongated guide slots 15 is therefore pushed obliquely upwardly along the obliquely extending elongated guide slots 15 by the guide arcuate surface 8*c* of the end of the actuation arm 8, while causing no interference with the actuation rod 16. The actuation rod 16 is again moved to return to the lowermost position within the obliquely extending elongated guide slots 15, so that the one end of the actuation arm 8 is automatically engaged in the placed-on fashion by the actuation rod 16 and that the actuation arm 8 is held in the upwardly tilted position. Simultaneously with this operation, two divided bottom plate parts 3A and 3B are completely closed, so that the bottom of the box pallet 1 itself is closed.

The box pallet 1 itself is thereafter moved to its predetermined original position and the fork of the fork lift truck, etc. is removed from the receptor fittings 6 and 39.

In this embodiment, as described above, by means of the automatic operation means constituted by the pivotal levers 43, the abutting plate 45, the connecting arms 46, the connecting rods 48, etc., the actuation member 38 can be automatically pivoted to automatically open the two divided bottom plate parts 3A and 3B of the box pallet 1, other than the manual pivotal operation. Further, since the bottom plate parts 3A and 3B are interlocked by the actuation links 30 with the actuation arm 8 which performs the opening and closing control of the bottom plate parts 3A and 3B through engagement with and disengagement from the actuation rod 16 as the actuation member 8 is pivotally moved, the opening and closing operation of the bottom plate parts 3A and 3B and the engaging operation between the actuation arm 8 and the actuation rod 16 can be reliably performed.

A third embodiment of the present invention will now be described with reference to FIGS. 10 to 14.

In the drawings, numeral 101 generally designates a box pallet, and the box pallet 101 is formed in a box-like configuration having four sides formed by side plates 102A, 102B, 102C and 102D, a bottom divided into two bottom plate parts 103A and 103B at its substantially central portion, and an open top. The bottom plate parts 103A and 103B have edges which are positioned opposite to their dividing edges and are mounted by means of pivotal means such as hinges on the lower portions of the side plates 102A and 102B facing to each other, respectively, for the opening and closing movement. Support members 104A and 104B extend horizontally along the dividing edges. Each of the support members 104A and 104B has both ends which extend slightly outwardly from their corresponding bottom plate part 103A or 103B. Substantially gate-like receptor fittings 105 are mounted on an upper surface of each of the side plates 102A and 102B and are spaced from each other by a predetermined distance for receiving a fork of a fork lift truck, etc. Leg members 106 each having a desired length and having a cup-shaped lower portion extend from the lower portion at four corners.

On a position below the substantially central portion of each of the side plates 102C and 102D which are positioned in a direction perpendicular to the dividing edges of the bottom plate parts 103A and 103B, one end of an actuation arm 107 is supported by a support pin 107*a* such that the actuation arm 107 is vertically pivotally movable along the corresponding side plate 102C or 102D. An arm portion 107*b* of the actuation arm 107 has one end which extends slightly beyond one lateral edge of the side plate 102C when the actuation arm 107 is in an upwardly tilted position. The one end of the arm portion 107*b* is expanded to form a desired guide arcuate surface 107*c*. Two actuation links 108 constituting interlocking means and having a length different from each other are disposed obliquely and supported by a common pivotal support pin 109 at the substantially central portion of the actuation arm 107, so that the actuation links 108 are vertically pivotally movable along the side plates 102C and 102D, respectively. By means of pivotal support pins 111, lower portions of these two actuation links 108 are pivotally connected, via brackets 110, to end portions of support members 104 which extend along the lower side of the dividing edges of the two divided bottom plate parts 103A and 103B, respectively, so that the actuation links 108 are permitted to be pivotally moved.

Support brackets 112 extend obliquely from both sides of the substantially upper portion of the side plate 102A positioned on one side. An actuation rod 113 having a long length is supported horizontally between both support brackets 112. The actuation rod 113 is supported such that the actuation rod 113 is movable on and along the support brackets 112 in a direction away from the side plate 102A or in a direction to move on and away from the pivotal locus of one end of the actuation arm 107, and the operational rod 113 extends outwardly.

On both sides of the substantially upper portion of the side plate 102A positioned on one side and perpendicular to the side plate 102C, substantially triangular lever-like mounting plates 115 are pivotally supported at their substantially central corner portions by mounting brackets 114 via pivot pins 116, respectively, and are positioned in spaced relationship with each other by a predetermined distance. Elongated holes 117 are formed through the lower corner portions of the mounting plates 115, respectively, and the actuation rod 113 is loosely inserted into the elongated holes 117 so as to be supported. A gate-like operation member 118 constituting first operation means is obliquely mounted on the upper portions of the mounting plates 115.

Thus, by pivoting the operation member 118 in a direction toward the side plate 102A, the mounting plates 115 are pivoted around the pivot pins 116 as their fulcrums, respectively. As the mounting plates 115 are thus pivoted, the actuation rod 113 is moved on and along the support brackets 112 in the direction away from the side plate 102A or in the direction away from the pivotal locus of the end of the actuation arm 107. On the other hand, by the pivotal movement of the operation member 118 in a direction away from the side plate 102A by its gravity, the mounting plates 115 are pivoted around the pivot pins 116 as their fulcrums. As the mounting plates 115 are thus pivoted, the actuation rod 113 is moved on and along the support brackets 112 in the direction toward the side plate 102A or in the direction toward a position on the pivotal locus of the end of the actuation arm 108. When both ends of the actuation rod 113 are positioned at the lowermost position with respect to the support brackets 112 and extend beyond the lateral edges of the side plate 102A, respectively, they are on the pivotal locus of the end of the actuation arm 107 and engage the end of the actuation arm 107 for holding the upwardly tilted position of the actuation arm 107. As both ends of the actuation rod 113 are moved on and along the support brackets 112 obliquely upwardly (in the direction away from the side plate 102A) toward the uppermost position relative to the support brackets 112, both ends of the actuation rod 113 are moved away from the pivotal locus of the end of the actuation arm 107 so as to release the placed-on engagement with the end of the actuation arm 107 and to permit downward pivotal movement of the actuation arm 107.

Fork insertion members 119 each having a hollow configuration in section for receiving a fork (not shown) of a fork lift truck, etc. are disposed on both lateral sides of the lower portion of the box pallet 101 in spaced relationship from each other by a predetermined distance. The fork insertion members 119 are positioned on the upper surfaces of the bottom plate parts 103A and 103B and extend between side plates 102A and 102B which are perpendicular to the side plate 102C. The fork of the fork lift truck, etc. is inserted into the fork insertion members 119 for lifting the whole box pallet 101 and for lowering the same.

On the side of the bottom plate part 103B which is one of two divided bottom plate parts 103A and 103B, mounting brackets 120 each having a rectangular configuration are mounted on both ends of the support member 104. A guide wheel 122 is rotatably supported on one side of each of the mounting brackets 120 via an arm 121. On the side of the bottom plate part 103B of the other side, mounting brackets 123 each having a rectangular configuration are mounted on both ends of the support member 104. A guide wheel 125 is rotatably supported on each of the mounting brackets 123 via an arm 124 and is positioned inwardly of the corresponding guide wheel 122 in facing relationship therewith. Set positions of the peripheral portions of both guide wheels 122 and 125 are determined such that they are positioned in flush with the upper surfaces of the leg portions 106 or are positioned slightly inwardly of the leg portions 106 or within the height of the leg portions 106. Further, both the mounting brackets 120 and 123 are determined to have substantially the same height as the leg portions 106.

The construction will now be explained in connection with automatic operation means constituting a second operation means for automatically performing the opening and closing operation of the two divided bottom plate parts 103A and 103B.

A pivotal lever 126 is disposed vertically along one of the lateral edges of each of the side plates 102C and 102D. At the substantially central portion, the pivotal lever 126 is pivotally supported on the side plate 102C or 102D by means of a support pin **126*a*. The pivotal lever 126 has an upper end 126*b* which extends to the substantially upper portion of the box pallet 101 and which is bent at substantially right angles at this position. The pivotal lever 126 has a lower end extending to the lower portion of the box pallet 101 or a position below the fork insertion members 119. An abutting plate 127 connects the lower portions of the pivotal levers 126 to each other and extends horizontally along the side plate 102B positioned on the other side. Connecting arms 128 are disposed on the substantially upper portions of the side plates 102C and 102D and extend horizontally along the side plates 102C and 102D, respectively. Each of the connecting arms 128 has one end pivotally supported on a bent part 126*b* of the upper end of the corresponding pivotal lever 126 by means of a support pin 129 and has the other end pivotally supported by the end portion of the actuation link 130 on the side of the operation member 118 via a support pin 131. An elongated hole 130*a* is formed through each connecting arm 128 on the side of the actuation link 130. Guide pins 132 extend from the side plates 102C and 102D and are loosely inserted into their corresponding elongated holes 130*a* for providing guide for movement of the connecting arms 128. Further, each of the actuation links 130 has a front end formed with a plurality (three in the drawings) of engaging recesses 133A, 133B and 133C (first to third engaging recesses) which are spaced from each other by a predetermined distance. The engaging recesses 133A, 133B and 133C are positioned in facing relationship with corresponding one of connecting rods 134 extending from both sides of the actuation member 118 and are engageable with and disengageable from the corresponding connecting rod 134**.

Thus, with the above automatic actuation means, when the abutting plate 127 of the pivotal levers 126 is pushed to be moved toward the side plate 102B, the pivotal levers 126 are pivoted about the support pins **126*a*, respectively, in the clockwise direction in the drawings, so that the bent parts 126*b* at the upper ends of the pivotal levers 126 are pivotally moved along the lateral edge surface of the side plate 102C. The connecting arms 128 and the actuation links 130 are therefore moved in such a manner that they are pulled rightwardly in the drawings, so that the operation member 118 connected integrally with the actuation links 130 via connecting rods 134 each in engagement with either one of the engaging recesses 133A, 133B and 133C of the corresponding operational link 130 is pivoted toward the side plate 102A. The relationship between the actuation rod 113 and the end of the actuation arm 107 is then released in the same manner as described above, so that the actuation arm 107 is permitted to be downwardly pivoted. Here, the state where the first engaging recess 133A at the front end of the actuation link 130 is in engagement with the connecting rod 134 corresponds to the state where the operation member 118 may not be pivoted since no pivotal range is provided for the pivotal lever 126, or a lock state where the bottom plate parts 103A and 103B are not permitted to be pivoted and are maintained in the closed position; the state where the second engaging recess 133B is in engagement with the connecting rod 134 corresponds to the state where the pivotal range of the pivotal lever 126 is small (small in angle) when the operation member 118 is pivoted; and the state where the third engaging recess 133C is in engagement with the connecting rod 134 corresponding to the state where the pivotal movement of the operation member 118 may be momentarily pivoted while the pivotal range of the pivotal lever 126 is greater (greater in angle) than the above case. Further, when the actuation link 130 is pivoted relative to the connecting arm 128 such that none of the engaging recesses 133A, 133B and 133C is brought in engagement with the connecting rod 134, the operation member 118** is permitted to be solely pivoted.

The box pallet 101 of this embodiment is constructed as described above and is adapted to accommodate desired articles such as wastes which are put into the box pallet 101 from the upper side thereof with the two divided bottom plate parts 103A and 103B being in their closed position.

The description will now proceed in connection with the operation for taking out the accommodated articles such as wastes from the box pallet 101.

In this embodiment, first, with the connecting rod 134 engaged with one of the engaging recesses 133B and 133C, a fork of a fork lift truck, etc. is inserted into the receptor fittings 105 or the fork inserting members 119 positioned at the substantially lower portion of the box pallet 101 so that, by the fork lift truck, etc., the whole box pallet 101 is hung up and moved to a predetermined position such as the position above the load-carrying platform of the truck for conveying the articles such as wastes.

The operation member 118 is then pivoted toward the side plate 102A by the operator, or the operation member 118 is pivoted toward the side plate 102A by the automatic actuation means. In order to pivot the operation member 118 toward the side plate 102A by the automatic operation means, the whole box pallet 101 is positioned slightly below an upper portion of the side panel (not shown) of the truck and is pulled toward the side panel of the truck. The abutting plate 127 of the pivotal levers 126 constituting the automatic operation means is then brought to abut on the side panel of the truck and is pushed toward the side plate 102B of the box pallet 101, so that the pivotal levers 126 are pivoted around their corresponding support pins **126*a* in the clockwise direction in the drawings, resulting in that the bent part 126*b* at the upper end of each of the pivotal levers 126 is pivoted and shifted along the lateral edge surface of the side plate 102C. The connecting arms 128 and the actuation links 130 are therefore moved while being pulled in the rightward direction in the drawings and while being capable of pivotal movement by the support pins 129 and 131 (as for the actuation links 130, they are guided by the elongated holes 130*a* and the guide pins 132), and the operation member 118 which is integrally connected to the actuation links 130 through the connecting rods 134 each in engagement with one engaging recess 133B of the corresponding operational link 130 is pivoted toward the side plate 102A**.

As the operation member 118 is pivoted toward the side plate 102A as described above, the mounting plates 115 are pivoted around the pivot pins 116 as fulcrums, respectively. With the pivotal movement of the mounting plates 115, the actuation rod 113 is moved obliquely upwardly (in the direction away from the side plate 102A) or is moved in the direction away from the pivotal locus of the end of the operational arm 107 from its lowermost position to its uppermost position relative to the support brackets 112 along the support brackets 112.

As the actuation rod 113 is moved toward the uppermost position relative to the support brackets 112, the placed-on engagement with the end of the actuation arm 107 is automatically released to permit the downward pivotal movement of the actuation arm 107. Then, the actuation arm 107 is pivoted (in the counterclockwise direction in the drawings) to the downwardly tilted position (downwardly pivoted position along the side plate 102C) by its gravity, etc., and through interlocking with such pivotal movement, the actuation links 108 are operated to be gradually shifted downwardly for positively opening the bottom plate parts 103A and 103B, respectively. With the operation of the actuation links 108, the bottom plate parts 103A and 103B are pivoted around the portions of the hinges, etc. relative to the side plates 102A and 102B, respectively, so as to be opened in the directions toward both lateral sides (to be opened like a double-leafed hinged door) by their gravity multiplied by the weight of the accommodated articles such as waste, so that the bottom of the box pallet 101 itself is opened. The articles such as wastes accommodated within the box pallet 101 are thus taken out therefrom.

When the whole box pallet 101 is moved downwardly with both guide wheels 122 and 125 of the bottom plate parts 103A and 103B being in abutment on a placing surface after the articles such as wastes accommodated within the box pallet 101 have been taken out, with the downward movement of the box pallet 101, the bottom plate parts 103A and 103B are positively pivoted toward the closed position so as to close the bottom of the box pallet 101 while maintaining the abutting relationship of the guide wheels 122 and 125 with the placing surface.

Thus, in this embodiment, during the opening and closing operation of the bottom plate parts 103A and 103B, the guide wheels 122 and 125 disposed on both bottom plate parts 103A and 103B are rotated while contacting the placing surface so as to guide the opening and closing operation of the bottom plate parts 103A and 103B, so that the opening and closing operation of the bottom plate parts 103A and 103B can be excellently (smoothly) performed.

With the positive pivotal movement of the bottom plate parts 103A and 103B toward the closed position, the actuation links 108 are shifted upwardly to pivot the actuation arm 107 in the clockwise direction in the drawings. The actuation rod 113 at the lowermost position relative to the support brackets 112 is therefore pushed obliquely upwardly along the support brackets 112, while causing no interference with the actuation rod 113, and the actuation rod 113 is again moved to return to the lowermost position relative to the support brackets 112, so that the one end of the actuation arm 107 is automatically engaged by the actuation rod 113 and that the actuation arm 107 is held in the upwardly tilted position. Simultaneously with this operation, two divided bottom plate parts 103A and 103B are completely closed, so that the bottom of the box pallet 101 itself is closed.

The box pallet 101 itself is thereafter moved to its predetermined original position and the fork of the fork lift truck, etc. is removed from the receptor fittings 105 or the fork insertion member 119.

In this embodiment, as described above, the automatic operation means constituted by the pivotal levers 126, the abutting plate 127, the connecting arms 128, the actuation links 130, the connecting rods 134, etc. can be operated also from a remote position by means of a desired measure. Further, even with the pivotal operation solely by the operation member 118 through manual operation, the two divided bottom plate parts 103A and 103B of the box pallet 101 can be opened through pivotal movement of the operation member 118. In this case, the actuation link 130 is pivoted relative to the corresponding actuation arm 128 such that the connecting rod 134 is not brought in engagement with either of the recesses 133A, 133B and 133C. When the first engaging recess 133A of the actuation link 130 is brought to engage the corresponding connecting rod 134, there is provided the state where the operation member 118 may not be pivoted since no pivotal range is provided for the pivotal lever 126, or the lock state where the bottom plate parts 103A and 103B are not permitted to be pivoted and are maintained in the completely closed position. When the second engaging recess 133B is brought to engage the connecting rod 134, there is provided the state where the pivotal angle of the pivotal lever 126 is small for the pivotal movement of the operation member 118 at a normal speed. When the third engaging recess 133C is brought to engage the connecting rod 134, the pivotal movement of the operation member 118 may be momentarily pivoted while the pivotal angle of the pivotal lever 126 is great. This means that the automatic operation means for the remote operation of the operation member 118 can be set in various conditions and that the safety of the automatic operation means can be improved.

Further, since the bottom plate parts 103A and 103B are interlocked, by the actuation links 108, with the actuation arm 107 which is engaged with and disengaged from the actuation rod 113 as the operation member 118 is pivotally moved, the opening and closing operation of the bottom plate parts 103A and 103B and the engaging operation between the actuation arm 107 and the actuation rod 113 can be reliably performed.

The construction of the guide wheels 122 and 125 in this embodiment can be applied to the afore-mentioned first embodiment.

I claim:

1. A box pallet having an open top, a plurality of side plates and a bottom plate for surrounding the box pallet on four sides and a bottom, said bottom plate being divided into two bottom plate parts and being assembled to move in a downward direction for opening said bottom, the box pallet comprising an actuation arm vertically pivotal about a pivot axis supported by one of two opposite side plates of said plurality of side plates, an interlocking member provided for interlocking between said actuation arm and said two divided bottom plate parts so as to permit opening and closing movement of each bottom plate part, and an actuation rod horizontally supported such that said actuation rod can change its position in a plane perpendicular to said pivot axis of said actuation arm between a first position within a pivotal range of said actuation arm for engagement with said actuation arm and a second position out of the pivotal range of said actuation arm for disengagement from said actuation arm, and said bottom plate parts being permitted to be opened when said actuation rod is in said second position.

2. The box pallet as defined in claim 1, wherein said interlocking member further comprises an actuation link means having one end pivotally connected to each of said two divided bottom plate parts and having the other end pivotally connected to said actuation arm on the pivot axis of said actuation arm.

3. The box pallet as defined in claim 1, further comprising leg portions having a desired height disposed on a lower side of the box pallet at substantially four corners thereof, and a first guide wheel rotatably supported by means of a bracket on one of said bottom plate parts, and a second guide wheel positioned inwardly of said first guide wheel in facing relationship therewith and rotatably supported by means of a second bracket on the other of said bottom plate parts, and both of said guide wheels positioned within the height of said leg portions.

4. The box pallet as defined in claim 3, wherein said brackets on which said guide wheels are mounted are positioned at the same level as said leg portions when said bottom plate parts are closed.

5. The box pallet as defined in claim 1, wherein said actuation rod is moveable between said first position and said second position substantially in a radial direction about the pivotal axis of said actuation arm.

6. The box pallet as defined in claim 5, further comprising guide means for permitting said actuation rod to be slidably moved between said first position and said second position.

7. The box pallet as defined in claim 6 wherein said guide means further comprises a guide surface inclined relative to a horizontal direction, so that said actuation rod is moveable along said guide surface.

8. A box pallet having an open top, a side plate and a bottom plate for surrounding the box pallet on four sides and a bottom, said bottom plate being divided into two bottom plate parts and being assembled to move for opening and closing, the box pallet comprising an actuation arm vertically pivotally supported by said side plate, said actuation arm having an outer end pivotal over a vertical range of motion, an interlocking member provided for interlocking between said actuation arm and said two divided bottom plate parts so as to permit opening and closing movement of each bottom plate part, an actuation rod horizontally supported such that said actuation rod can change its position between a position within the vertical range of motion of said actuation arm outer end and a position out of the vertical range of motion of said actuation arm outer end and is engageable with and disengageable from said actuation arm, said bottom plate parts being held to be closed when said actuation rod is in engagement with said actuation arm, and said bottom plate parts being permitted to be opened when said actuation rod is in disengagement from said actuation arm, an operation member pivotally mounted on said side plate and interlocked with said actuation rod for controlling the change in position of said actuation rod, a pivotal lever pivotally supported by said side plate and pivotally moveable by means different from that for said operation member, and interlocking means for transmitting the pivotal movement of said pivotal lever to said operation member, and said interlocking means being interlocked with said operation member such that the pivotal angle of said pivotal lever is adjustable relative to said operation member.

9. The box pallet as defined in claim 8, wherein a connecting rod is mounted on said operation member so as to extend therefrom, said interlocking means is formed with a plurality of engaging recesses for engagement with and disengagement from said connecting rod, said engaging recesses are set to at least positions for preventing said pivotal lever from pivotal movement and for permitting the pivotal movement of said pivotal lever, when said connecting rod is in engagement with corresponding engaging recess.

10. The box pallet as defined in claim 8, wherein said actuation arm is engageable with said actuation rod when it is in an upwardly tilted position.

11. The box pallet as defined in claim 8, further comprising leg portions having a desired height disposed on a lower side of the box pallet at substantially four corners therof, a first guide wheel rotatably supported by means of a first bracket on one side of said bottom plate parts to be opened and closed, a second guide wheel positioned inwardly of said first guide wheel in facing relationship therewith and rotatably supported by means of a second bracket on the other of said bottom plate parts, both of said guide wheels being positioned within the height of said leg portions.

12. The box pallet as defined in claim 11, wherein said brackets on which said guide wheels are mounted are positioned at the same level as said leg portions when said bottom plate parts are closed.

13. A box pallet having an open top, a side plate and a bottom plate for surrounding the box pallet on four sides and a bottom, said bottom plate being divided into two bottom plate parts and being assembled to move in a downward direction for opening said bottom, the box pallet comprising an actuation arm vertically pivotally supported by said side plate, an interlocking member provided for interlocking between said actuation arm and said two divided bottom plate parts so as to permit opening and closing movement of each bottom plate part, an actuation rod horizontally supported such that said actuation rod can change its position in a plane perpendicular to a pivotal axis of said actuation arm between a first position within a pivotal range of said actuation arm for engagement with said actuation arm and a second position out of the pivotal range of said actuation arm for disengagement from said actuation arm, said bottom plate parts being permitted to by opened when said actuation rod is in said second position, and a first operation means on said actuation rod for changing the position of said actuation rod by human power, and a second operation means on said actuation rod for changing the position of said actuation rod by different motive power from said first operation means.

* * * * *